US009817326B2

(12) United States Patent
Yamamoto et al.

(10) Patent No.: US 9,817,326 B2
(45) Date of Patent: Nov. 14, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yuki Yamamoto, Tokyo (JP); Atsushi Fujii, Yokohama (JP); Atsushi Okuda, Yokohama (JP); Yuka Ishiduka, Suntou-gun (JP); Kazunori Noguchi, Suntou-gun (JP); Akihiro Maruyama, Mishima (JP); Nobuhiro Nakamura, Numazu (JP); Kazuko Sakuma, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/006,006

(22) Filed: Jan. 25, 2016

(65) Prior Publication Data

US 2016/0216622 A1 Jul. 28, 2016

(30) Foreign Application Priority Data

Jan. 26, 2015 (JP) ..... 2015-012707
Jun. 11, 2015 (JP) ..... 2015-118571

(51) Int. Cl.

| | |
|---|---|
| ***G03G 5/04*** | (2006.01) |
| ***G03G 5/08*** | (2006.01) |
| ***G03G 5/14*** | (2006.01) |
| ***G03G 5/05*** | (2006.01) |
| ***G03G 5/047*** | (2006.01) |

(52) U.S. Cl.

CPC ..... *G03G 5/144* (2013.01); *G03G 5/047* (2013.01); *G03G 5/0528* (2013.01)

(58) Field of Classification Search

CPC ..... G03G 5/144; G03G 5/0528; G03G 5/047
See application file for complete search history.

(56) References Cited

U.S. PATENT DOCUMENTS

2002/0064721 A1* 5/2002 Ishii ..... G03G 5/047 430/69
2011/0318681 A1* 12/2011 Osada ..... G03G 5/14704 430/66

FOREIGN PATENT DOCUMENTS

JP 6-313977 * 8/1994
JP 2000075528 A 3/2000
JP 2004177552 A 6/2004

* cited by examiner

*Primary Examiner* — Thorl Chea
(74) *Attorney, Agent, or Firm* — Canon U.S.A., Inc. IP Division

(57) ABSTRACT

A support, a conductive layer, and an intermediate layer of an electrophotographic photosensitive member have a particular surface profile. The intermediate layer is a cured film containing particles.

9 Claims, 6 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge, and an electrophotographic apparatus.

Description of the Related Art

Some electrophotographic photosensitive members for use in process cartridges and electrophotographic apparatuses contain an organic photoconductive substance (a charge-generating substance).

Electrophotographic photosensitive members generally include a support and a photosensitive layer disposed on the support. Typical photosensitive layers are multi-layer type photosensitive layers that include a charge-generating layer and a charge-transport layer on a support in this order. In order to reduce charge injection from the support to the photosensitive layer and thereby reduce the occurrence of image failures, such as black spots, an intermediate layer is disposed between the support and the photosensitive layer. Furthermore, a conductive layer may be disposed between the support and the intermediate layer.

In multi-layer type photosensitive members, when a laser beam is used as an exposure light source, interference fringes may occur in latent images due to multiple reflection of exposure light within the photosensitive members. In particular, the occurrence of interference fringes increases with unevenness in the thickness of a charge-transport layer or a protective layer disposed on a charge-generating layer.

In order to solve this problem, it is effective to reduce unevenness in the thickness of a charge-transport layer or a protective layer. However, unevenness in film thickness that is responsible for interference fringes is on the order of tens of nanometers. It is difficult with respect to production techniques and cost to produce charge-transport layers and protective layers that have unevenness in thickness smaller than tens of nanometers. Thus, there is a demand for methods for reducing interference fringes irrespective of unevenness in the thickness of charge-transport layers and protective layers.

In one method for reducing interference fringes, a layer under a charge-generating layer is roughened in order to form many fine interference fringes for the averaging effects and thereby reduce macroscopic interference fringes. In other methods for reducing interference fringes, inorganic particles in an intermediate layer scatter a laser beam, or a light-absorbing compound in an intermediate layer absorbs a laser beam.

For example, Japanese Patent Laid-Open No. 2000-075528 describes a method for roughening a support of an electrophotographic photosensitive member that functions as a reflective surface. Japanese Patent Laid-Open No. 2004-177552 describes a method in which an intermediate layer contains metal oxide particles as a white pigment.

In one technique for forming a photosensitive layer on an intermediate layer, particularly by coating using a solvent, in order to prevent the swelling of the intermediate layer caused by the solvent, the intermediate layer comprises a cured film formed by curing an organic compound having a reactive functional group.

SUMMARY OF THE INVENTION

The present invention relates to an electrophotographic photosensitive member including a support, an intermediate layer adjacent to the support, a charge-generating layer, and a charge-transport layer in this order, wherein the intermediate layer has a thickness of 6.0 μm or less, the intermediate layer comprises a cured film containing dispersed particles having a number-average particle size of 0.3 μm or less, a surface of the support has an average local height difference (Rmk) of 0.1 μm or more along a calculation length in the range of 0.5 $Lm_1$ (μm) or more and 1.5 $Lm_1$ (μm) or less, and a surface of the intermediate layer has an average local height difference (Rmk) of 0.08 μm or more along a calculation length in the range of 0.5 $Lm_2$ (μm) or more and 1.5 $Lm_2$ (μm) or less, wherein $Lm_1$ denotes a calculation length in the range of 0.1 μm or more and 100 μm or less along which the surface of the support has a maximum average local height difference (Rmk,max), and $Lm_2$ denotes a calculation length in the range of 0.1 μm or more and 100 μm or less along which the surface of the intermediate layer has a maximum average local height difference (Rmk,max).

The present invention also relates to an electrophotographic photosensitive member including a support, a conductive layer, an intermediate layer adjacent to the conductive layer, a charge-generating layer, and a charge-transport layer in this order, wherein the intermediate layer has a thickness of 6.0 μm or less, the intermediate layer comprises a cured film containing dispersed particles having a number-average particle size of 0.3 μm or less, a surface of the conductive layer has an average local height difference (Rmk) of 0.1 μm or more along a calculation length in the range of 0.5 $Lm_3$ (μm) or more and 1.5 $Lm_3$ (μm) or less, and a surface of the intermediate layer has an average local height difference (Rmk) of 0.08 μm or more along a calculation length in the range of 0.5 $Lm_4$ (μm) or more and 1.5 $Lm_4$ (μm) or less, wherein $Lm_3$ denotes a calculation length in the range of 0.1 μm or more and 100 μm or less along which the surface of the conductive layer has a maximum average local height difference (Rmk,max), and $Lm_4$ denotes a calculation length in the range of 0.1 μm or more and 100 μm or less along which the surface of the intermediate layer has a maximum average local height difference (Rmk,max).

The present invention also relates to a process cartridge detachably attachable to a main body of an electrophotographic apparatus, wherein the process cartridge integrally supports the electrophotographic photosensitive member described above and at least one device selected from the group consisting of a charging device, a developing device, a transfer device, and a cleaning device.

The present invention also relates to an electrophotographic apparatus that includes the electrophotographic photosensitive member, a charging device, an exposure device, a developing device, and a transfer device.

Further features of the present invention will become apparent from the following description of exemplary embodiments with reference to the attached drawings.

DESCRIPTION OF THE EMBODIMENTS

Figure 1A:
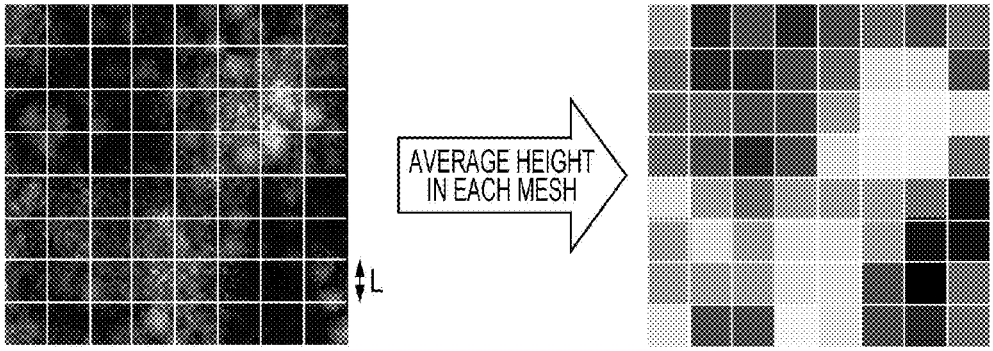
FIG. 1A is a schematic view of the mesh division of three-dimensional surface profile data in the calculation of Rmk(L).

The present inventors found the following on the basis of our study results. When a cured film having a thickness of 6.0 μm or less is formed as an intermediate layer on a roughened support or conductive layer, the intermediate layer flattens the roughened surface of the support or conductive layer and diminish the effect of reducing interference fringes. This is probably because contraction stress in a curing process reduces the surface area of the intermediate layer.

With increasing quality requirements for electrophotographic images, the permissible limit of interference fringes is being significantly narrowed. When an intermediate layer comprising a thin cured film is disposed between a support and a photosensitive layer, as described above, there is a room for improvement in further suppression of interference fringes.

The present invention provides an electrophotographic photosensitive member that can sufficiently reduce the occurrence of interference fringes when an intermediate layer comprising a thin cured film is used, and a process cartridge and an electrophotographic apparatus each including the electrophotographic photosensitive member.

An electrophotographic photosensitive member according to an embodiment of the present invention includes a support, an intermediate layer adjacent to the support, a charge-generating layer, and a charge-transport layer in this order. The intermediate layer has a thickness of 6.0 μm or less and comprises a cured film containing dispersed particles having a number-average particle size of 0.3 μm or less. A surface of the support has an average local height difference (Rmk) of 0.1 μm or more along a calculation length (L) in the range of 0.5 $Lm_1$ (μm) or more and 1.5 $Lm_1$ (μm) or less. A surface of the intermediate layer has an average local height difference (Rmk) of 0.08 μm or more along a calculation length (L) in the range of 0.5 $Lm_2$ (μm) or more and 1.5 $Lm_2$ (μm) or less.

$Lm_1$ denotes a calculation length in the range of 0.1 μm or more and 100 μm or less along which the surface of the support has a maximum average local height difference (Rmk,max). $Lm_2$ denotes a calculation length in the range of 0.1 μm or more and 100 μm or less along which the surface of the intermediate layer has a maximum average local height difference (Rmk,max).

An electrophotographic photosensitive member according to another embodiment of the present invention includes a support, a conductive layer, an intermediate layer adjacent to the conductive layer, a charge-generating layer, and a charge-transport layer in this order. The intermediate layer has a thickness of 6.0 μm or less and comprises a cured film containing dispersed particles having a number-average particle size of 0.3 μm or less. A surface of the conductive layer has an average local height difference (Rmk) of 0.1 μm or more along a calculation length (L) in the range of 0.5 $Lm_3$ (μm) or more and 1.5 $Lm_3$ (μm) or less. A surface of the intermediate layer has an average local height difference (Rmk) of 0.08 μm or more along a calculation length (L) in the range of 0.5 $Lm_4$ (μm) or more and 1.5 $Lm_4$ (μm) or less.

$Lm_3$ denotes a calculation length in the range of 0.1 μm or more and 100 μm or less along which the surface of the conductive layer has a maximum average local height difference (Rmk,max). $Lm_4$ denotes a calculation length in the range of 0.1 μm or more and 100 μm or less along which the surface of the intermediate layer has a maximum average local height difference (Rmk,max).

The dependence of the average local height difference (Rmk) on the calculation length (L) will be described below. This parameter can be calculated using the following procedures (1) to (5). After the three-dimensional surface profile data z(x, y) of a target support, conductive layer, or intermediate layer is measured, (1) divide the resulting surface profile data into meshes each having a length L (see the figure on the left in FIG. 1A).

(2) Average the height z(x, y) in each mesh having a length L (see the figure on the right in FIG. 1A).

(3) Calculate the local height difference for each mesh from the difference in height between the mesh and its surrounding meshes.

(4) Average the local height differences of all the meshes. The average is referred to as the average local height difference Rmk.

(5) Repeatedly change the length L and perform the procedures (1) to (4) to determine the function Rmk(L), which is the dependence of the average local height difference (Rmk) on the calculation length (L).

Figure 1B:
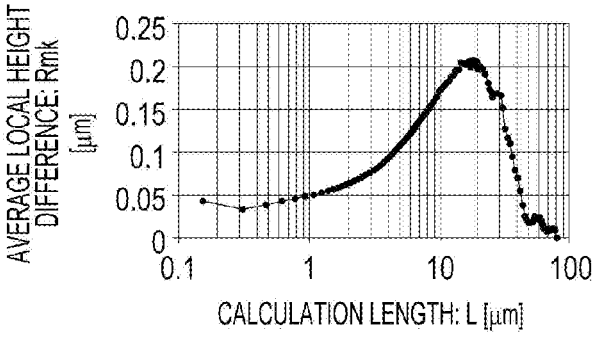
FIG. 1B is a graph of calculated Rmk(L) data in which the axis of abscissae is the logarithm of L.

FIG. 1B is a graph of Rmk(L), wherein the axis of abscissae is the logarithm of the calculation length L (μm), and the axis of ordinates is the average local height difference Rmk (μm).

In FIG. 1B, the maximum value of Rmk is 0.206 (μm) at L=Lm=18.3 (μm). This is referred to as Rmk,max=0.206 (μm). Lm refers to $Lm_1$, $Lm_2$, $Lm_3$, or $Lm_4$ depending on the target (the support, conductive layer, or intermediate layer).

In FIG. 1B, the calculation length (L) in the range of 0.5 Lm or more and 1.5 Lm or less ranges from L=Lm×0.5=9.15 (μm) to L=Lm×1.5=27.45 (μm). Lm is a general term for $Lm_1$, $Lm_2$, $Lm_3$, and $Lm_4$.

In brief, the graph of Rmk calculated through the procedures described above is drawn by dividing the surface roughness values of different roughness scales (L) and plotting the value of each roughness scale. Greater and broader values on an Rmk(L) curve indicate a surface having "random roughness" including more roughness values of different scales. In order to form many fine interference fringes for the averaging effects and thereby reduce macroscopic interference fringes, as described above, the formation of a surface profile having "random roughness" is known to be effective. Thus, in the present invention, because of its close correlation with the occurrence of interference fringes, Rmk is used in the surface profile evaluation.

A method for measuring three-dimensional surface profile data in the present invention will be described below. Three-dimensional surface profile data may be measured under any conditions. For example, commercially available atomic force microscopes, electron microscopes, laser microscopes, optical microscopes, and optical interference three-dimensional surface profilers can be utilized.

Such a measuring instrument can be used to measure vertical height data z(x, y) corresponding to horizontal direction coordinates (x, y) and acquire three-dimensional surface profile data. Rmk(L) is derived from the three-dimensional surface profile data, as described above.

The structure of an electrophotographic photosensitive member according to an embodiment of the present invention will be described below. An electrophotographic photosensitive member according to an embodiment of the present invention may have the following two structures.

1. A support, an intermediate layer directly above the support, a charge-generating layer on the intermediate layer, and a charge-transport layer on the charge-generating layer.
2. A support, a conductive layer on the support, an intermediate layer directly above the conductive layer, a charge-generating layer on the intermediate layer, and a charge-transport layer on the charge-generating layer.

Although cylindrical electrophotographic photosensitive members are widely used, belt-like or sheet-like electrophotographic photosensitive members may also be used.

Each component will be described below.

[Support]

The support can be electrically conductive (an electrically conductive support). For example, the support may be made of a metal or alloy, such as aluminum, nickel, copper, gold, and/or iron. A thin film formed of a metal, such as aluminum, silver, and/or gold, or a thin film formed of an electrically conductive material, such as indium oxide or tin oxide, may be formed on an insulative support, for example, formed of a polyester resin, polycarbonate resin, polyimide resin, or glass. Aluminum supports and aluminum alloy supports may be produced from extruded and drawn (ED) tubes or extruded and ironed (EI) tubes.

A support directly under an intermediate layer having a thickness of 6.0 μm or less has the following surface profile. A surface of the support has an average local height difference (Rmk) of 0.1 μm or more along a calculation length (L) in the range of 0.5 $Lm_1$ (μm) or more and 1.5 $Lm_1$ (μm) or less. This can effectively reduce interference fringes. $Lm_1$ denotes a calculation length in the range of 0.1 μm or more and 100 μm or less along which the surface of the support has a maximum average local height difference (Rmk,max).

A surface of the support preferably has an average local height difference (Rmk) of 0.1 μm or more and 0.3 μm or less along a calculation length (L) in the range of 0.5 $Lm_1$ (μm) or more and 1.5 $Lm_1$ (μm) or less.

The support can satisfy the average local height difference, for example, through a honing process, laser ablation processing, or abrasive blasting.

A support that is not disposed directly under an intermediate layer having a thickness of 6.0 μm or less may have any surface profile. A surface of the support may be subjected to electrochemical treatment, such as anodic oxidation, and/or cutting.

[Conductive Layer]

At least one conductive layer may be disposed between the support and an intermediate layer described later. For example, the conductive layer can be formed by forming a coating film of a conductive layer coating fluid on the support and drying the coating film. The conductive layer coating fluid contains conductive particles dispersed in a binder resin. Examples of the conductive particles include, but are not limited to, carbon black, acetylene black, metal powders of aluminum, nickel, iron, nichrome, copper, zinc, and silver, and powders of metal oxides, such as conductive tin oxide and indium-tin oxide (ITO).

Examples of the binder resin include, but are not limited to, polyester resins, polycarbonate resins, poly(vinyl butyral) resins, acrylic resins, silicone resins, epoxy resins, melamine resins, urethane resins, phenolic resins, and alkyd resins.

Examples of solvents for use in the conductive layer coating fluid include, but are not limited to, ether solvents, alcohol solvents, ketone solvents, and aromatic hydrocarbon solvents. The conductive layer preferably has a thickness in the range of 0.2 to 40 μm, more preferably 1 to 35 μm, still more preferably 5 to 30 μm.

If present, the conductive layer has the following surface profile. A surface of the conductive layer has an average local height difference (Rmk) of 0.1 μm or more along a calculation length (L) in the range of 0.5 $Lm_3$ (μm) or more and 1.5 $Lm_3$ (μm) or less. This can effectively reduce interference fringes. $Lm_3$ denotes a calculation length in the range of 0.1 μm or more and 100 μm or less along which the surface of the conductive layer has a maximum average local height difference (Rmk,max).

A surface of the conductive layer preferably has an average local height difference (Rmk) of 0.1 μm or more and 0.3 μm or less along a calculation length (L) in the range of 0.5 $Lm_3$ (μm) or more and 1.5 $Lm_3$ (μm) or less.

When the conductive layer includes a plurality of layers, the top conductive layer has the surface profile described above, and the other conductive layers may have any surface profile.

The conductive layer can satisfy the average local height difference, for example, by adding a surface roughening agent to the conductive layer. Examples of the surface roughening agent include, but are not limited to, resin particles of curable rubbers, polyurethanes, poly(methyl methacrylate), epoxy resins, alkyd resins, phenolic resins, polyesters, silicone resins, and acryl-melamine resins.

[Intermediate Layer]

An electrophotographic photosensitive member according to an embodiment of the present invention includes an intermediate layer.

The intermediate layer has the following surface profile. A surface of the intermediate layer has an average local height difference (Rmk) of 0.08 μm or more along a calculation length in the range of 0.5 $Lm_2$ (μm) or more and 1.5 $Lm_2$ (μm) or less, or 0.5 $Lm_4$ (μm) or more and 1.5 $Lm_4$ (μm) or less. This can effectively reduce interference fringes.

A surface of the intermediate layer preferably has an average local height difference (Rmk) of 0.08 μm or more and 0.25 μm or less along a calculation length in the range of 0.5 $Lm_2$ (μm) or more and 1.5 $Lm_2$ (μm) or less, or 0.5 $Lm_4$ (μm) or more and 1.5 $Lm_4$ (μm) or less.

The intermediate layer comprises a cured film containing dispersed particles having a number-average particle size of 0.3 μm or less. The cured film can contain a polymer of a composition containing an organic compound having a polymerizable functional group.

For example, the intermediate layer can be formed by forming a coating film of an intermediate layer coating fluid and drying and curing the coating film. The intermediate layer coating fluid contains particles having a number-average particle size of 0.3 μm or less and an organic compound having a polymerizable functional group. For example, the intermediate layer can be cured by heat, light, or radiation (such as an electron beam).

The organic compound having a polymerizable functional group may be a resin or a crosslinking agent.

Examples of the resin include, but are not limited to, acetal resins, such as butyral resins, polyolefin resins, polyester resins, polyether resins, polyamide resins, alkyd resins, and polyvinyl resins. Among these, thermoplastic resins having a polymerizable functional group that can react with a crosslinking agent may be used.

The crosslinking agent may be a compound that can polymerized (cured) or cross-linked with a compound having a polymerizable functional group. More specifically, compounds described in "Kakyozai Handobukku (Crosslinking Agent Handbook)", edited by Shinzo Yamashita and Tosuke Kaneko, Taiseisha Ltd. (1981) can be used.

Examples of the crosslinking agent include, but are not limited to, crosslinking agents having an isocyanate group, an alkylol group, an epoxy group, a carboxy group, and an oxazoline group. Among these, isocyanate compounds having an isocyanate group or a blocked isocyanate group, or amine compounds having an alkylol group or an alkyl-etherified alkylol group may be used.

Isocyanate compounds having two to six isocyanate groups or blocked isocyanate groups may be used. Examples of such isocyanate compounds include, but are not limited to, triisocyanatobenzene, triisocyanatomethylbenzene, triphenylmethane triisocyanate, and lysine triisocyanate, and isocyanurate modified products, biuret modified products, allophanate modified products, and trimethylolpropane and pentaerythritol adduct modified products of diisocyanates, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate, and norbornane diisocyanate. Among these, isocyanurate modified products may be used. The isocyanate compounds preferably have a molecular weight in the range of 200 to 1,300.

Amine compounds having two to six alkylol groups or alkyl-etherified alkylol groups may be used. Examples of such amine compounds include, but are not limited to, melamine derivatives, such as hexamethylolmelamine, pentamethylolmelamine, and tetramethylolmelamine, guanamine derivatives, such as tetramethylolbenzoguanamine and tetramethylolcyclohexyl guanamine, and urea derivatives, such as dimethyloldihydroxyethylene urea, tetramethylolacetylene diurea, and tetramethylol urea. Among these, melamine derivatives may be used. The amine compounds preferably have a molecular weight in the range of 150 to 1,000, more preferably 180 to 560.

The intermediate layer may contain an electron-transport substance and/or an electron-accepting substance. Examples of the electron-transport substance include, but are not limited to, quinone compounds, imide compounds, benzimidazole compounds, and cyclopentadienylidene compounds. An electron-transport substance having a polymerizable functional group may also be used. When an electron-transport substance having a polymerizable functional group is used, the intermediate layer contains a polymer of a composition containing the electron-transport substance having a polymerizable functional group and a crosslinking agent.

All the organic compounds in the intermediate layer do not necessarily involved in the formation of the cured film.

The intermediate layer contains particles having a number-average particle size of 0.3 μm or less dispersed therein. The particles in the intermediate layer can effectively reduce interference fringes. This is probably because the particles reduce contraction stress in the curing process and weaken the force that reduces the surface area of the intermediate layer. This probably improves adaptability to the surface profile of a layer (the support or the conductive layer) directly under the intermediate layer and thereby reduces interference fringes.

The intermediate layer has a thickness of 6.0 μm or less, preferably 0.3 μm or more and 6.0 μm or less.

The particles dispersed in the intermediate layer have a number-average particle size of 0.3 μm or less. A number-average particle size of 0.3 μm or less probably results in an enhanced effect of reducing contraction stress. In order to more effectively reduce interference fringes, the number-average particle size of the particles is preferably 0.005 μm or more and 0.2 μm or less, more preferably 0.005 μm or more and 0.1 μm or less.

The particle content of the intermediate layer is preferably 0.7% or more by volume and 13% or less by volume of the total volume of the intermediate layer. A particle content of 0.7% or more by volume results in a more effective reduction of interference fringes. A particle content of 13% or less by volume results in a more effective reduction of charge injection.

The particles in the intermediate layer will be described in detail below.

The particles may be inorganic particles or organic resin particles. In particular, inorganic particles may be used in order to more effectively achieve the advantages of the present invention.

Examples of the inorganic particles include, but are not limited to, metal oxides, inorganic salts, such as inorganic chlorides and inorganic bromides, inorganic oxides, clay, and ceramics, such as silicon nitride. Among these, inorganic oxides may be used in terms of the chemical stability of the compound. In particular, silica, alumina, titanium oxide, and zinc oxide may be used. These may be used alone or in combination.

The surface of inorganic particles may be subjected to hydrophobic treatment. A surface-treating agent, for example, a silane coupling agent may be used. Examples of the silane coupling agent include, but are not limited to, γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, and p-methylphenyltrimethoxysilane.

Examples of the organic resin particles include, but are not limited to, resin particles of curable rubbers, polyurethanes, poly(methyl methacrylate), epoxy resins, alkyd resins, phenolic resins, polyesters, silicone resins, acrylmelamine resins, and resins containing a fluorine atom.

The shape of the particles can be defined by solidity described later. In order to more effectively reduce interference fringes, the particles preferably have a solidity of 0.90 or less. This is probably because a solidity of 0.90 or less results in a greater contact region between the particles and organic substances in the cured film, such as a polymer, and results in promoted relaxation of contraction stress. The particles more preferably have a solidity of 0.80 or less. Examples of the particles having a shape that satisfies the solidity include, but are not limited to, chains of spherical particles, star-shaped particles, spherical particles having a rough surface, and porous particles.

The intermediate layer coating fluid may be mixed with a powder or a slurry containing particles dispersed in a solvent. A powder can be dispersed with an emulsifying or dispersing apparatus, such as a homogenizer, a line mixer, an ultradisperser, a homo mixer, a liquid-collision-type high-speed dispersing apparatus, or an ultrasonic homogenizer, or a mixing apparatus, such as a mixer.

[Charge-Generating Layer]

A charge-generating layer is formed on the intermediate layer. The charge-generating layer contains a charge-generating substance and a binder resin. The charge-generating layer can be formed by forming a coating film of a charge-generating layer coating fluid and drying the coating film. The charge-generating layer coating fluid contains the charge-generating substance and the binder resin.

Examples of the charge-generating substance include, but are not limited to, azo pigments, perylene pigments, anthraquinone derivatives, anthanthrone derivatives, dibenzpyrenequinone derivatives, pyranthrone derivatives, violanthrone derivatives, isoviolanthrone derivatives, indigo derivatives, thioindigo derivatives, phthalocyanine pigments, such as metal phthalocyanines and metal-free phthalocyanines, and bisbenzimidazole derivatives. Among these, at least one of azo pigments and phthalocyanine pigments may be used. Among phthalocyanine pigments, oxytitanium phthalocyanine, chlorogallium phthalocyanine, and hydroxygallium phthalocyanine may be used.

The oxytitanium phthalocyanine may be the following. One example is oxytitanium phthalocyanine crystals in a crystal form having peaks at Bragg angles (2θ±0.2 degrees) of 9.0, 14.2, 23.9, and 27.1 degrees in CuKα characteristic X-ray diffractometry. Another example is oxytitanium phthalocyanine crystals in a crystal form having peaks at Bragg angles (2θ±0.2 degrees) of 9.5, 9.7, 11.7, 15.0, 23.5, 24.1, and 27.3 degrees.

The chlorogallium phthalocyanine may be the following. One example is chlorogallium phthalocyanine crystals in a crystal form having peaks at Bragg angles (2θ±0.2 degrees) of 7.4, 16.6, 25.5, and 28.2 degrees in CuKα characteristic X-ray diffractometry. Another example is chlorogallium phthalocyanine crystals in a crystal form having peaks at Bragg angles (2θ±0.2 degrees) of 6.8, 17.3, 23.6, and 26.9 degrees. Still another example is chlorogallium phthalocyanine crystals in a crystal form having peaks at Bragg angles (2θ±0.2 degrees) of 8.7, 9.2, 17.6, 24.0, 27.4, and 28.8 degrees.

The hydroxygallium phthalocyanine may be the following. One example is hydroxygallium phthalocyanine crystals in a crystal form having peaks at Bragg angles (2θ±0.2 degrees) of 7.3, 24.9, and 28.1 degrees in CuKα characteristic X-ray diffractometry. Another example is hydroxygallium phthalocyanine crystals in a crystal form having peaks at Bragg angles (2θ±0.2 degrees) of 7.5, 9.9, 12.5, 16.3, 18.6, 25.1, and 28.3 degrees in CuKα characteristic X-ray diffractometry.

Examples of the binder resin for use in the charge-generating layer include, but are not limited to, polymers and copolymers of vinyl compounds, such as styrene, vinyl acetate, vinyl chloride, acrylate, methacrylate, vinylidene fluoride, and trifluoroethylene, poly(vinyl alcohol) resins, poly(vinyl acetal) resins, polycarbonate resins, polyester resins, polysulfone resins, poly(phenylene oxide) resins, polyurethane resins, cellulose resins, phenolic resins, melamine resins, silicon resins, and epoxy resins. Among these, polyester resins, polycarbonate resins, and poly(vinyl acetal) resins may be used. In particular, poly(vinyl acetal) may be used.

In the charge-generating layer, the mass ratio of the charge-generating substance to the binder resin preferably ranges from 10/1 to 1/10, more preferably 5/1 to 1/5. Examples of solvents for use in the charge-generating layer coating fluid include, but are not limited to, alcohol solvents, sulfoxide solvents, ketone solvents, ether solvents, ester solvents, and aromatic hydrocarbon solvents.

The charge-generating layer preferably has a thickness of 0.05 μm or more and 5 μm or less.

[Charge-Transport Layer]

A charge-transport layer is formed on the charge-generating layer. The charge-transport layer contains a charge-transport substance and a binder resin. The charge-transport layer can be formed by forming a coating film of a charge-transport layer coating fluid and drying the coating film. The charge-transport layer coating fluid contains the charge-transport substance and the binder resin.

Examples of the charge-transport substance include, but are not limited to, polycyclic aromatic compounds, heterocyclic compounds, hydrazone compounds, styryl compounds, benzidine compounds, triarylamine compounds, triphenylamine, and polymers having a group derived from these compounds in the main chain or a side chain. Among these, triarylamine compounds, benzidine compounds, and styryl compounds may be used.

Examples of the binder resin for use in the charge-transport layer include, but are not limited to, polyester resins, polycarbonate resins, polymethacrylate resins, polyarylate resins, polysulfone resins, and polystyrene resins. Among these, polycarbonate resins and polyarylate resins may be used. Such a binder resin preferably has a weight-average molecular weight Mw in the range of 5,000 to 300,000.

In the charge-transport layer, the mass ratio of the charge-transport substance to the binder resin (charge-transport substance/binder resin) preferably ranges from 10/5 to 5/10, more preferably 10/8 to 6/10.

The charge-transport layer preferably has a thickness of 3 μm or more and 40 μm or less, more preferably 5 μm or more and 25 μm or less. Examples of solvents for use in the charge-transport layer coating fluid include, but are not limited to, alcohol solvents, sulfoxide solvents, ketone solvents, ether solvents, ester solvents, and aromatic hydrocarbon solvents.

The charge-transport layer may be covered with a protective layer. The protective layer contains conductive particles or a charge-transport substance and a binder resin. The protective layer may further contain an additive agent, such as a lubricant. The binder resin in the protective layer may have electroconductivity or charge-transport properties. In such a case, the protective layer does not have to contain components other than the resin, such as conductive particles or a charge-transport substance. The binder resin in the protective layer may be a thermoplastic resin or a curable resin, which can be polymerized by heat, light, or radiation (such as an electron beam).

In a multi-layer type electrophotographic photosensitive member, each layer can be formed as described below. First, the materials of each layer are dissolved and/or dispersed in a solvent to prepare a coating fluid. The coating fluid is formed into a coating film. The coating film is then dried and/or cured. The coating fluid can be applied by a dip coating method, spray coating method, a curtain coating method, or a spin coating method. Among these, a dip coating method is efficient and productive.

[Process Cartridge and Electrophotographic Apparatus]

Figure 2:
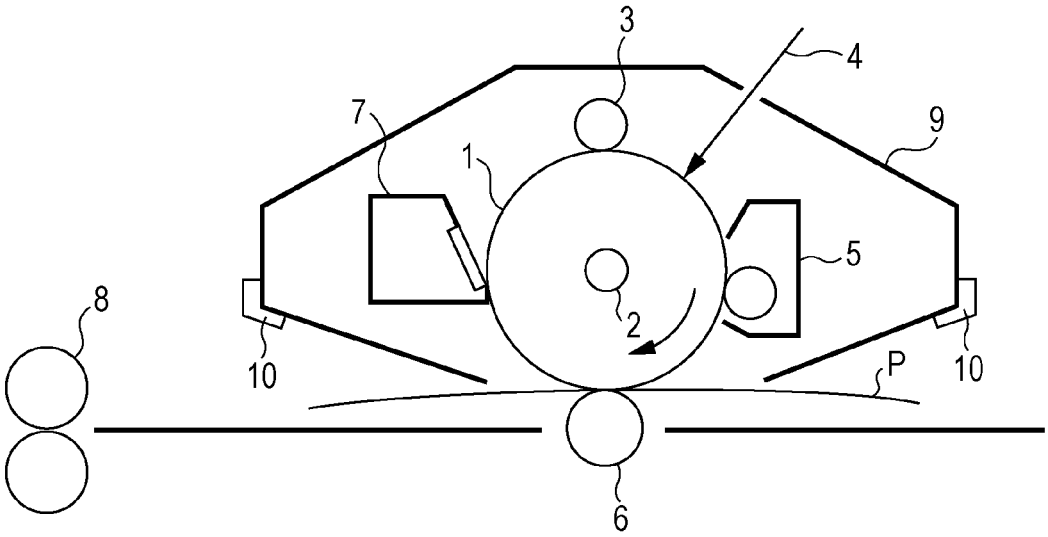
FIG. 2 is a schematic view of an electrophotographic apparatus including a process cartridge.

FIG. 2 is a schematic view of an electrophotographic apparatus having a process cartridge including an electrophotographic photosensitive member.

In FIG. 2, a cylindrical electrophotographic photosensitive member 1 rotates on a shaft 2 in the direction of the arrow at a predetermined circumferential velocity. The surface of the rotating electrophotographic photosensitive member 1 is uniformly charged to a predetermined positive or negative potential with a charging device 3 (a primary charging member, such as a charging roller). The surface of the rotating electrophotographic photosensitive member 1 is then subjected to exposure light (image exposure light) 4 of exposure means (not shown), such as slit exposure or laser beam scanning exposure. In this manner, electrostatic latent images for an intended image are successively formed on the surface of the electrophotographic photosensitive member 1.

An electrostatic latent image on the surface of the electrophotographic photosensitive member 1 is then developed with toner contained in a developer stored in a developing device 5 to form a toner image. The toner image on the surface of the electrophotographic photosensitive member 1 is then transferred to a transfer material (such as a paper sheet) P in response to a transfer bias from a transfer device (such as a transfer roller) 6. The transfer material P is fed from a transfer material supply unit (not shown) to a contact portion between the electrophotographic photosensitive member 1 and the transfer device 6 in synchronism with the rotation of the electrophotographic photosensitive member 1.

The transfer material P to which the toner image has been transferred is separated from the electrophotographic photosensitive member 1 and is sent to a fixing means 8 to fix the toner image. The resulting image-formed article (a print or copy) is then transported to the outside of the apparatus.

After toner image transfer, the surface of the electrophotographic photosensitive member 1 is cleared of the residual developer (toner) with a cleaning device (such as a cleaning blade) 7. The surface of the electrophotographic photosensitive member 1 is then irradiated with pre-exposure light (not shown) emitted from a pre-exposure device (not shown) to remove electricity. Then, the electrophotographic photosensitive member 1 is again used for image formation. In the case where the charging device 3 is a contact charging device, such as a charging roller, as illustrated in FIG. 2, pre-exposure is not necessarily required.

At least two of the electrophotographic photosensitive member 1, the charging device 3, the developing device 5, the transfer device 6, and the cleaning device 7 are housed in a container and used as a process cartridge. The process cartridge may be detachably attached to a main body of an electrophotographic apparatus, such as a copying machine or a laser-beam printer. In FIG. 2, the electrophotographic photosensitive member 1, the charging device 3, the developing device 5, and the cleaning device 7 are integrated into a process cartridge 9, which is detachably attachable to the main body of the electrophotographic apparatus through a guide unit 10, such as a rail, of the main body of the electrophotographic apparatus.

EXAMPLES

The present invention will be further described in the following exemplary embodiments. The term "part" in the Exemplary Embodiments refers to "part by mass".

Exemplary Embodiment 1

Support: An uneven portion (surface profile) was formed on an aluminum support having a length of 260.5 mm and a diameter of 30 mm using a wet honing machine (manufactured by Fujiseiki Corporation) under the following conditions.

<Liquid Honing Conditions>

Abrasive grains: spherical alumina beads (trade name: CB-A30S manufactured by Showa Denko K.K.)

Suspension medium: water

Abrasive/suspension medium: 1/9 (volume ratio)

Rotational speed of aluminum support: 1.67 $s^{-1}$

Air blast pressure: 0.15 MPa

Gun traverse speed: 13.3 mm/s

Distance between gun nozzle and aluminum support: 190 mm

Ejection angle of honing abrasive grains: 45 degrees

Number of abrasive liquid ejections: 1

Then, 5 parts of a compound represented by the following formula (A-1) (an electron-transport substance having a polymerizable functional group), 8.6 parts of a blocked isocyanate compound (trade name: SBN-70D, manufactured by Asahi Kasei Chemicals Corporation), 0.6 parts of a poly(vinyl acetal) resin (trade name: KS-5Z, manufactured by Sekisui Chemical Co., Ltd.), and 0.15 parts of zinc (II) hexanoate (trade name: zinc (II) hexanoate, manufactured by Mitsuwa Chemicals Co., Ltd.) were dissolved in a mixed solvent of 45 parts of 1-methoxy-2-propanol and 45 parts of tetrahydrofuran. The solution was then mixed with 3.3 parts of a slurry containing silica particles dispersed in isopropanol (trade name: IPA-ST-UP, silica ratio: 15% by mass, manufactured by Nissan Chemical Industries, Ltd.).

The intermediate layer coating fluid thus prepared was applied to a support by dip coating. The resulting coating film was cured (polymerized) at 160° C. for 40 minutes to form an intermediate layer. The intermediate layer had a thickness of 1 μm and comprised the cured film containing dispersed silica particles.

[Chem. 1]

(A-1)

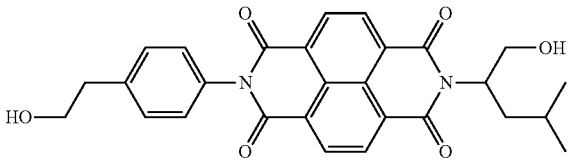

Then, 10 parts of hydroxygallium phthalocyanine crystals (a charge-generating substance) in a crystal form having peaks at Bragg angles (2θ±0.2 degrees) of 7.5, 9.9, 12.5, 16.3, 18.6, 25.1, and 28.3 degrees in CuKα characteristic X-ray diffractometry, 5 parts of poly(vinyl butyral) (trade name: S-Lec BX-1, manufactured by Sekisui Chemical Co., Ltd.), and 250 parts of cyclohexanone were dispersed with glass beads having a diameter of 1 mm in a sand mill for 2 hours. Then, 250 parts of ethyl acetate was added to the mixture to prepare a charge-generating layer coating fluid.

The charge-generating layer coating fluid was applied to the intermediate layer by dip coating to form a coating film. The coating film was dried at 95° C. for 10 minutes to form a charge-generating layer having a thickness of 0.17 μm.

Then, 8 parts of an amine compound represented by the following formula (B-1) and parts of a polyester resin having a structural unit represented by the following formula (C-1) and a structural unit represented by the following formula (C-2) at a mole ratio of 5/5 and having a weight-average molecular weight Mw of 100,000 were dissolved in a mixed solvent of 40 parts of dimethoxymethane and 60 parts of o-xylene to prepare a charge-transport layer coating fluid.

[Chem. 2]

(B-1)

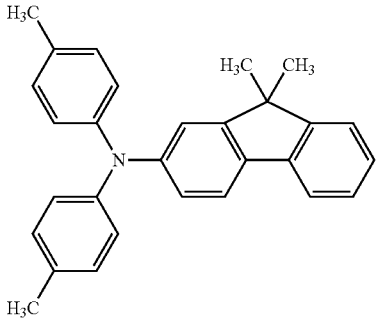

[Chem. 3]

(C-1)

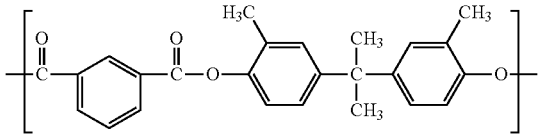

(C-2)

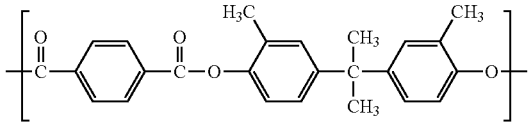

Figure 4A:
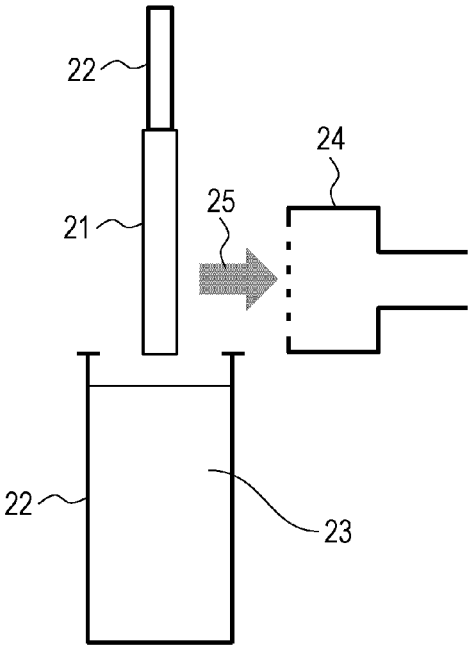
FIG. 4A is a schematic view of a "method A for forming a charge-transport layer" described later.
Figure 4B:
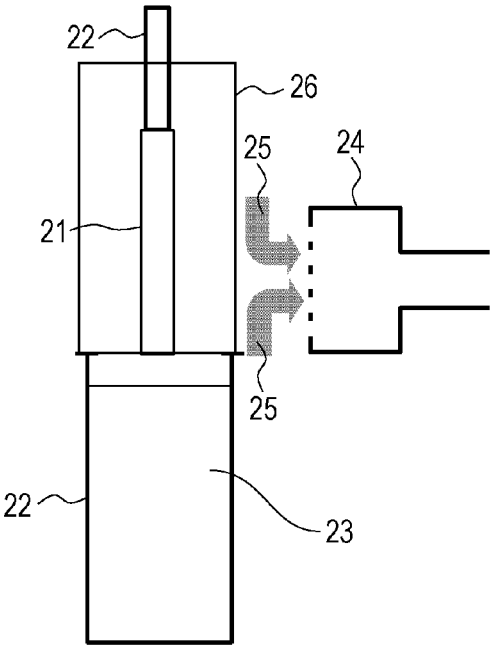
FIG. 4B is a schematic view of a "method B for forming a charge-transport layer" described later.

The charge-transport layer coating fluid was applied to the charge-generating layer by dip coating by the following two methods. Two electrophotographic photosensitive members thus produced had different unevenness in the thickness of the charge-transport layer. In one method (a method A for forming a charge-transport layer), as illustrated in FIG. 4A, a local exhaust ventilation was placed approximately 50 cm apart from an electrophotographic photosensitive member such that the suction airflow of the local exhaust ventilation blew directly against the electrophotographic photosensitive member during dip coating of the charge-transport layer. In the other method (a method B for forming a charge-transport layer), as illustrated in FIG. 4B, an electrophotographic photosensitive member was placed within an acrylic tube such that the suction airflow of the local exhaust ventilation did not blow directly against the electrophotographic photosensitive member during dip coating of the charge-transport layer. In both of the methods, the coating film formed by dip coating was dried at 120° C. for 40 minutes.

The thickness of the charge-transport layer of the electrophotographic photosensitive member formed by the method A for forming a charge-transport layer was measured at 20 positions in the circumferential direction 130 mm apart from the upper end of the electrophotographic photosensitive member. An eddy current thickness gauge (manufactured by Kett Electric Laboratory) was used for the measurement. The average thickness of the 20 positions was 15 μm, and the difference between the maximum value and the minimum value was 1.5 μm. The thickness of the charge-transport layer of the electrophotographic photosensitive member produced by the method B for forming a charge-transport layer was measured in the same manner. The average thickness of the 20 positions was 15 μm, and the difference between the maximum value and the minimum value was 0.5 μm.

The surface profiles of the support and the intermediate layer were measured by the following method.

<Measurement of Surface Profile of Intermediate Layer>

The charge-generating layer and the charge-transport layer on the intermediate layer of the electrophotographic photosensitive member were removed using a solvent that does not dissolve or swell the intermediate layer but can dissolve the charge-generating layer and the charge-transport layer. Either of the electrophotographic photosensitive members produced by the method A for forming a charge-transport layer and the method B for forming a charge-transport layer may be used.

Figure 3A:
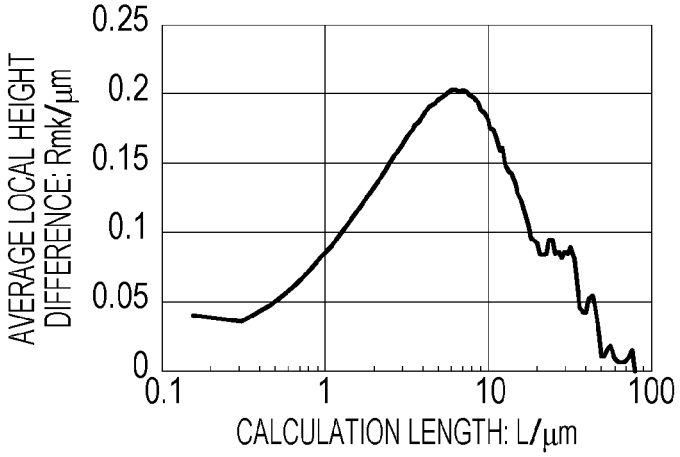
FIGS. 3A and 3E are graphs of Rmk(L) calculated from the surface of a support as a function of the logarithm of L.
Figure 3B:
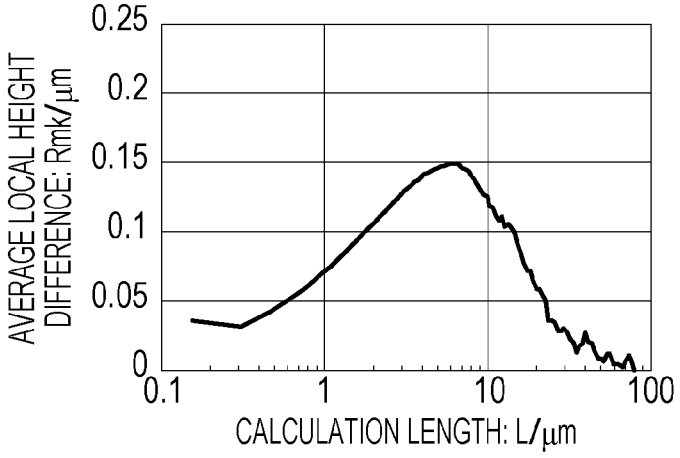
FIGS. 3B and 3D are graphs of Rmk(L) calculated from the surface of an intermediate layer as a function of the logarithm of L.

The surface of the intermediate layer was observed with a profile measuring laser microscope (VK-X200, manufactured by Keyence Corporation). Rmk(L) was calculated by the method described above. FIG. 3B and Table 1 show the Rmk(L) calculation results. The maximum value Rmk,max of Rmk along the calculation length in the range of 0.1 μm or more and 100 μm or less was 0.150 μm. The calculation length $Lm_2$ of Rmk,max was 6.094 μm. Rmk along the calculation length of 0.5 $Lm_2$, Rmk(0.5 $Lm_2$), was 0.127 μm, and Rmk along the calculation length of 1.5 $Lm_2$, Rmk(1.5 $Lm_2$), was 0.111 μm. FIG. 3B shows that Rmk along the calculation length in the range of 0.5 $Lm_2$ (μm) or more and 1.5 $Lm_2$ (μm) or less was 0.08 μm or more.

<Measurement of Surface Profile of Support>

The intermediate layer, the charge-generating layer, and the charge-transport layer on the support of the electrophotographic photosensitive member were removed using a solvent that can dissolve each of the layers. Either of the electrophotographic photosensitive members produced by the method A for forming a charge-transport layer and the method B for forming a charge-transport layer may be used.

The surface of the support was observed with a profile measuring laser microscope (VK-X200, manufactured by Keyence Corporation). Rmk(L) was calculated using the procedures described above. FIG. 3A and Table 1 show the Rmk(L) calculation results. The maximum value Rmk,max of Rmk along the calculation length in the range of 0.1 μm or more and 100 μm or less was 0.203 μm. The calculation length $Lm_1$ of Rmk,max was 7.031 μm. Rmk along the calculation length of 0.5 $Lm_1$, Rmk(0.5 $Lm_1$), was 0.177 μm, and Rmk along the calculation length of 1.5 $Lm_1$, Rmk(1.5 $Lm_1$), was 0.174 μm. FIG. 3A shows that Rmk along the calculation length in the range of 0.5 $Lm_1$ (μm) or more and 1.5 $Lm_1$ (μm) or less was 0.1 μm or more.

The number-average particle size, content, and solidity of the particles in the intermediate layer were measured by the following methods.

<Measurement of Number-Average Particle Size of Particles>

The electrophotographic photosensitive member was sliced in order to observe a cross section thereof. The intermediate layer was observed with a transmission electron microscope (JEM-2800, manufactured by JEOL Ltd.). The number-average particle size was determined by randomly measuring and averaging the longest diameters of 100 isolated particles in an observed image. The image contrast and magnification were appropriately adjusted in order to clarify the boundaries between particles and a region other than the particles. Table 1 shows the results.

<Measurement of Particle Content>

A magnified cross-sectional image was obtained in the same manner as in the <Measurement of Number-Average Particle Size of Particles>. The observed image was binarized with image analysis software (Image-Pro Plus, available from Media Cybernetics), and the areas of particles and a region other than the particles were determined. The area ratio of the particles in the intermediate layer was converted into the volume ratio to determine the particle content (% by volume). The particle content was measured in a portion of the intermediate layer having a length of 5 μm in the horizontal direction and having the same thickness as the intermediate layer. Table 1 shows the results.

<Measurement of Solidity of Particles>

Figure 5A:
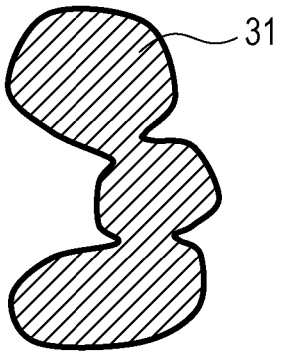
FIG. 5A is a schematic view illustrating the area of a particle.
Figure 5B:
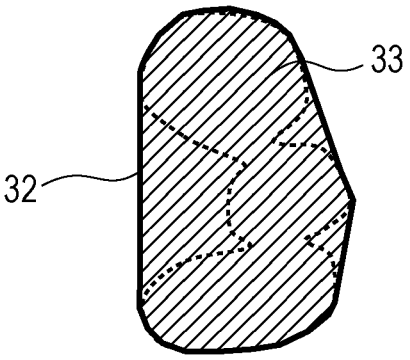
FIG. 5B is a schematic view of an envelope and the area within the envelope.

As illustrated in FIGS. 5A and 5B, the solidity of particles is determined from the area of a particle and the area within a line (envelope) surrounding the particle and the depressed portions. The solidity can define the volume of depressed portions in a particle. A particle having a greater volume of depressed portions has a smaller solidity.

A binarized image of particles and a region other than the particles in the intermediate layer was obtained in the same manner as in the <Measurement of Particle Content>. The area of each of 100 isolated particles randomly selected from the binarized image was determined.

An envelope was drawn around each of the selected particles on the binarized image to prepare an image of particles surrounded by the envelope. The area within the envelope of each particle on the image was determined by the method described above.

The ratio (the area of particle)/(the area within the envelope) of each of the 100 selected particles was determined. The solidity is the average of the ratios of the 100 particles. Table 1 shows the results.

<Evaluation>

Evaluation with Respect to Interference Fringes

A laser beam printer (LBP-2510, manufactured by CANON KABUSHIKI KAISHA) was used to output images.

A halftone image from the image output apparatus was visually inspected for the presence or absence of interference fringes. Photosensitive members produced by "the method A for forming a charge-transport layer" and "the method B for forming a charge-transport layer" were rated on the following scale of a to d with respect to interference fringes. Table 5 shows the evaluation results.

a: No interference fringes on the image.

b: A few interference fringes on the image.

c: Interference fringes on the image.

d: Many interference fringes on the image.

Exemplary Embodiments 2 and 3

Electrophotographic photosensitive members were produced and evaluated in the same manner as in Exemplary Embodiment 1 except that the intermediate layer had a thickness listed in Table 1. Tables 1 and 5 show the results.

Exemplary Embodiment 4

An electrophotographic photosensitive member was produced and evaluated in the same manner as in Exemplary Embodiment 1 except that 0.5 parts of the slurry containing silica particles dispersed in isopropanol mixed with the intermediate layer coating fluid was used. Tables 1 and 5 show the results.

Exemplary Embodiment 5

An electrophotographic photosensitive member was produced and evaluated in the same manner as in Exemplary Embodiment 1 except that 8.8 parts of the slurry containing silica particles dispersed in isopropanol mixed with the intermediate layer coating fluid was used. Tables 1 and 5 show the results.

Exemplary Embodiment 6

An electrophotographic photosensitive member was produced and evaluated in the same manner as in Exemplary Embodiment 1, except that, in the intermediate layer, the compound represented by the formula (A-1) was replaced with 5 parts of a compound represented by the following formula (A-2), and 3 parts of the poly(vinyl acetal) resin was used. Tables 1 and 5 show the results.

[Chem. 4]

(A-2)

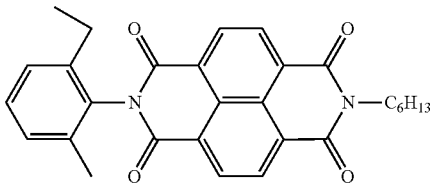

Exemplary Embodiment 7

An electrophotographic photosensitive member was produced and evaluated in the same manner as in Exemplary Embodiment 1 except that the intermediate layer was formed as described below. Tables 1 and 5 show the results.

[Intermediate Layer]

Ten parts of star-shaped titanium oxide particles (trade name: ST-K4-Si, manufactured by Sumitomo Osaka Cement Co., Ltd.) were dispersed in 10 parts of tetrahydrofuran with a homogenizer. The dispersion was left standing for 5 hours.

The upper half of the dispersion was then gently transferred to a container, and tetrahydrofuran was removed from the upper half by vacuum distillation. Thus, a powder of the star-shaped titanium oxide particles was produced.

Five parts of the compound represented by the formula (A-1),
8.6 parts of the blocked isocyanate compound (trade name: SBN-70D),
0.6 parts of the poly(vinyl acetal) resin (trade name: KS-5Z), and
0.15 parts of the zinc (II) hexanoate (trade name: zinc (II) hexanoate)
were dissolved in a mixed solvent of 45 parts of 1-methoxy-2-propanol and 45 parts of tetrahydrofuran. Then, 2.1 parts of the powder of the star-shaped titanium oxide particles was dispersed in the solution with glass beads having a diameter of 0.8 mm in a paint shaker for 3 hours. The glass beads were then removed. Thus, an intermediate layer coating fluid was prepared.

The intermediate layer coating fluid was applied to the support by dip coating to form a coating film. The coating film was cured (polymerized) at 160° C. for 40 minutes to form the intermediate layer, which had a thickness of 5.5 μm.

Exemplary Embodiment 8

An electrophotographic photosensitive member was produced and evaluated in the same manner as in Exemplary Embodiment 1 except that the intermediate layer was formed as described below. Tables 1 and 5 show the results.

The slurry containing silica particles dispersed in isopropanol mixed with the intermediate layer coating fluid was replaced with 2 parts of a powder of alumina particles (trade name: LS-231, manufactured by Nippon Light Metal Co., Ltd.). The powder of alumina particles was stirred with glass beads having a diameter of 0.8 mm in a paint shaker for 3 hours, and the glass beads were then removed. Except for these, the intermediate layer was formed in the same manner as in Exemplary Embodiment 1.

Exemplary Embodiment 9

An electrophotographic photosensitive member was produced and evaluated in the same manner as in Exemplary Embodiment 1 except that the air blast pressure in the wet honing process of the support was 0.05 MPa. Tables 1 and 5 show the results.

Exemplary Embodiment 10

An electrophotographic photosensitive member was produced and evaluated in the same manner as in Exemplary Embodiment 1, except that 0.33 parts of the slurry containing silica particles dispersed in isopropanol mixed with the intermediate layer coating fluid was used, and the intermediate layer had a thickness of 5.5 μm. Tables 1 and 5 show the results.

Exemplary Embodiments 11 to 13

Electrophotographic photosensitive members were produced and evaluated in the same manner as in Exemplary Embodiments 1 to 3 except that the intermediate layer was formed as described below. Tables 1 and 5 show the results. Exemplary Embodiment 11 corresponds to Exemplary Embodiment 1, Exemplary Embodiment 12 corresponds to Exemplary Embodiment 2, and Exemplary Embodiment 13 corresponds to Exemplary Embodiment 3.

The intermediate layer was formed in the same manner as in Exemplary Embodiments 1 to 3, except that the slurry containing silica particles dispersed in isopropanol (trade name: IPA-ST-UP) mixed with the intermediate layer coating fluid was replaced with 1.7 parts of another slurry containing silica particles dispersed in isopropanol (trade name: IPA-ST, silica ratio: 30% by mass, manufactured by Nissan Chemical Industries, Ltd.), and the intermediate layer had a thickness listed in Table 1.

Exemplary Embodiment 14

The slurry containing silica particles dispersed in isopropanol (trade name: IPA-ST-UP) mixed with the intermediate layer coating fluid was replaced with 1.7 parts of another slurry containing silica particles dispersed in isopropanol (trade name: IPA-ST-ZL, silica ratio: 30% by mass, manufactured by Nissan Chemical Industries, Ltd.). Except for this, the intermediate layer was formed in the same manner as in Exemplary Embodiment 1, and an electrophotographic photosensitive member was produced and evaluated. Tables 1 and 5 show the results.

Exemplary Embodiment 15

An electrophotographic photosensitive member was produced and evaluated in the same manner as in Exemplary Embodiment 1 except that the intermediate layer was formed as described below. Tables 1 and 5 show the results.

The slurry containing silica particles dispersed in isopropanol mixed with the intermediate layer coating fluid was replaced with 2.1 parts of a powder of titanium oxide particles (trade name: TTO-S-4, manufactured by Ishihara Sangyo Kaisha, Ltd.). The powder of titanium oxide particles was stirred with glass beads having a diameter of 0.8 mm in a paint shaker for 3 hours, and the glass beads were then removed. Except for these, the intermediate layer was formed in the same manner as in Exemplary Embodiment 1.

Exemplary Embodiment 16

An electrophotographic photosensitive member was produced and evaluated in the same manner as in Exemplary Embodiment 1 except that the intermediate layer was formed as described below. Tables 1 and 5 show the results.

The compound represented by the formula (A-1) was not used in the intermediate layer coating fluid. The slurry containing silica particles dispersed in isopropanol was replaced with 7.1 parts of a powder of zinc oxide particles (trade name: ZnO-650, manufactured by Sumitomo Osaka Cement Co., Ltd.). The powder of zinc oxide particles was stirred with glass beads having a diameter of 0.8 mm in a paint shaker for 3 hours, and the glass beads were then removed. Except for these, the intermediate layer was formed in the same manner as in Exemplary Embodiment 1.

TABLE 1

| | Support | | | |
|---|---|---|---|---|
| | Rmk, max (μm) | $Lm_1$ (μm) | Rmk(0.5 $Lm_1$) (μm) | Rmk(1.5 $Lm_1$) (μm) |
| Exemplary embodiment 1 | 0.20 | 7.03 | 0.18 | 0.17 |
| Exemplary embodiment 2 | 0.20 | 7.03 | 0.18 | 0.17 |
| Exemplary embodiment 3 | 0.20 | 7.03 | 0.18 | 0.17 |
| Exemplary embodiment 4 | 0.20 | 7.03 | 0.18 | 0.17 |
| Exemplary embodiment 5 | 0.20 | 7.03 | 0.18 | 0.17 |
| Exemplary embodiment 6 | 0.20 | 7.03 | 0.18 | 0.17 |
| Exemplary embodiment 7 | 0.20 | 7.03 | 0.18 | 0.17 |
| Exemplary embodiment 8 | 0.20 | 7.03 | 0.18 | 0.17 |
| Exemplary embodiment 9 | 0.12 | 6.09 | 0.10 | 0.11 |
| Exemplary embodiment 10 | 0.20 | 7.03 | 0.18 | 0.17 |
| Exemplary embodiment 11 | 0.20 | 7.03 | 0.18 | 0.17 |
| Exemplary embodiment 12 | 0.20 | 7.03 | 0.18 | 0.17 |
| Exemplary embodiment 13 | 0.20 | 7.03 | 0.18 | 0.17 |
| Exemplary embodiment 14 | 0.20 | 7.03 | 0.18 | 0.17 |
| Exemplary embodiment 15 | 0.20 | 7.03 | 0.18 | 0.17 |
| Exemplary embodiment 16 | 0.20 | 7.03 | 0.18 | 0.17 |

| | Intermediate layer | | | | | | | | |
|---|---|---|---|---|---|---|---|---|---|
| | Rmk, max (μm) | $Lm_2$ (μm) | Rmk(0.5 $Lm_2$) (μm) | Rmk(1.5 $Lm_2$) (μm) | Thickness (μm) | Particles | Particle size (μm) | Particle content (vol %) | Solidity |
| Exemplary embodiment 1 | 0.15 | 6.09 | 0.13 | 0.11 | 1.0 | Silica | 0.06 | 5 | 0.54 |
| Exemplary embodiment 2 | 0.13 | 6.09 | 0.12 | 0.12 | 5.5 | Silica | 0.06 | 5 | 0.54 |
| Exemplary embodiment 3 | 0.18 | 6.10 | 0.15 | 0.15 | 0.5 | Silica | 0.06 | 5 | 0.54 |
| Exemplary embodiment 4 | 0.15 | 6.03 | 0.11 | 0.12 | 1.0 | Silica | 0.06 | 0.7 | 0.54 |
| Exemplary embodiment 5 | 0.16 | 6.10 | 0.13 | 0.14 | 1.0 | Silica | 0.06 | 13 | 0.54 |
| Exemplary embodiment 6 | 0.14 | 6.10 | 0.12 | 0.12 | 1.0 | Silica | 0.06 | 5 | 0.54 |

TABLE 1-continued

| | | | | | | | | | |
|---|---|---|---|---|---|---|---|---|---|
| Exemplary embodiment 7 | 0.10 | 6.05 | 0.09 | 0.09 | 5.5 | Titanium oxide | 0.18 | 5 | 0.77 |
| Exemplary embodiment 8 | 0.13 | 6.06 | 0.11 | 0.12 | 1.0 | Alumina | 0.10 | 5 | 0.88 |
| Exemplary embodiment 9 | 0.10 | 5.10 | 0.09 | 0.09 | 1.0 | Silica | 0.06 | 5 | 0.54 |
| Exemplary embodiment 10 | 0.12 | 6.04 | 0.11 | 1.11 | 5.5 | Silica | 0.06 | 0.5 | 0.54 |
| Exemplary embodiment 11 | 0.13 | 6.00 | 0.12 | 0.11 | 1.0 | Silica | 0.01 | 5 | 0.98 |
| Exemplary embodiment 12 | 0.12 | 5.99 | 0.10 | 0.08 | 5.5 | Silica | 0.01 | 5 | 0.98 |
| Exemplary embodiment 13 | 0.14 | 6.07 | 0.13 | 0.13 | 0.5 | Silica | 0.01 | 5 | 0.98 |
| Exemplary embodiment 14 | 0.11 | 6.10 | 0.11 | 0.10 | 1.0 | Silica | 0.09 | 5 | 0.98 |
| Exemplary embodiment 15 | 0.12 | 6.20 | 0.11 | 0.11 | 1.0 | Titanium oxide | 0.07 | 5 | 0.92 |
| Exemplary embodiment 16 | 0.14 | 6.05 | 0.12 | 0.12 | 1.0 | Zinc oxide | 0.03 | 19 | 0.95 |

"Particles" in Table 1 refers to the type of particles dispersed in the intermediate layer. "Particle size" in Table 1 refers to the number-average particle size of particles measured by the Measurement of Number-Average Particle Size of Particles. "Particle content" in Table 1 refers to the particle content (% by volume) of the intermediate layer measured by the Measurement of Particle Content. "Solidity" in Table 1 refers to the solidity of particles measured by the Measurement of Solidity of Particles.

Exemplary Embodiment 17

Figure 3C:
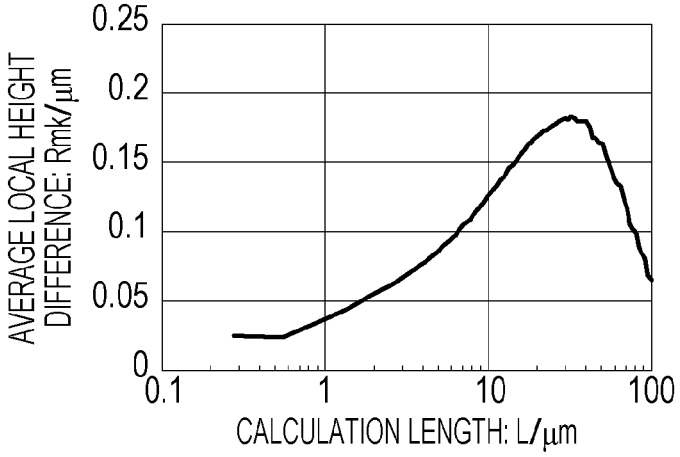
FIGS. 3C and 3F are graphs of Rmk(L) calculated from the surface of a conductive layer as a function of the logarithm of L.
Figure 3D:
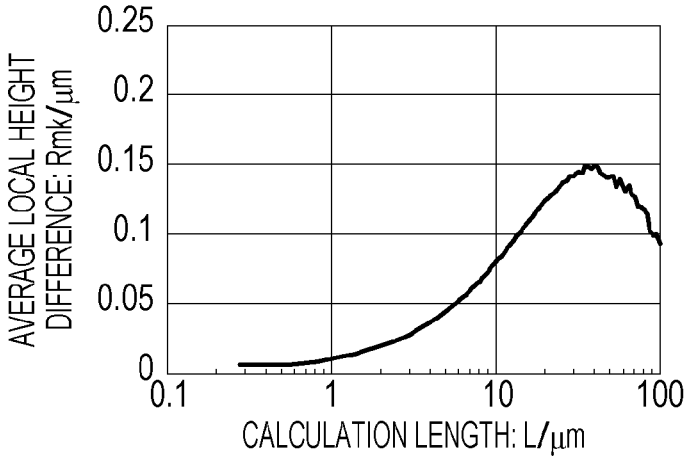

An electrophotographic photosensitive member was produced in the same manner as in Exemplary Embodiment 1, except that the surface treatment of the support was cutting, and a conductive layer was formed between the support and the intermediate layer. The conductive layer was formed as described below. In the evaluation of the photosensitive member, the <Measurement of Surface Profile of Support> was replaced with <Measurement of Surface Profile of Conductive Layer> described below. Tables 2 and 5 show the results. FIG. 3D shows the Rmk(L) calculation results of the <Measurement of Surface Profile of Intermediate Layer>.

[Conductive Layer]

214 parts of titanium oxide particles coated with oxygen-deficient tin oxide ($SnO_2$), 132 parts of a phenolic resin (a phenolic resin monomer/oligomer) (trade name: Plyophen J-325, manufactured by DIC Corporation, solid content of resin: 60% by mass), and 98 parts of 1-methoxy-2-propanol were dispersed with 450 parts of glass beads having a diameter of 0.8 mm in a sand mill at a rotational speed of 2000 rpm for 4.5 hours. The set temperature of cooling water was 18° C. Thus, a dispersion liquid was prepared.

The glass beads were removed from the dispersion liquid using a mesh (sieve opening: 150 μm. After removal of the glass beads, silicone resin particles (trade name: Tospearl 120, manufactured by Momentive Performance Materials Inc., average particle size: 2 μm) were added to the dispersion liquid. The silicone resin particles constituted 10% by mass of the total mass of the metal oxide particles and the phenolic resin in the dispersion liquid. A conductive layer coating fluid was prepared by adding a silicone oil (trade name: SH28PA, manufactured by Dow Corning Toray Co., Ltd.) to the dispersion liquid. The silicone oil constituted 0.01% by mass of the total mass of the metal oxide particles and the phenolic resin in the dispersion liquid. The conductive layer coating fluid was applied to the support by dip coating to form a coating film, and the coating film was dried and cured at 150° C. for 30 minutes to form a conductive layer having a thickness of 30 μm.

<Measurement of Surface Profile of Conductive Layer>

The intermediate layer, the charge-generating layer, and the charge-transport layer on the conductive layer of the electrophotographic photosensitive member were removed using a solvent that does not dissolve or swell the conductive layer but can dissolve the intermediate layer, the charge-generating layer, and the charge-transport layer. Either of the electrophotographic photosensitive members produced by the method A for forming a charge-transport layer and the method B for forming a charge-transport layer may be used.

The surface of the conductive layer was observed in the same manner as in the <Measurement of Surface Profile of Support>, and Rmk(L) was calculated. FIG. 3C and Table 2 show the Rmk(L) calculation results. The maximum value Rmk,max of Rmk along the calculation length in the range of 0.1 μm or more and 100 μm or less was 0.183 μm. The calculation length $Lm_3$ of Rmk,max was 32.392 μm. Rmk along the calculation length of 0.5 $Lm_3$, Rmk(0.5 $Lm_3$), was 0.156 μm, and Rmk along the calculation length of 1.5 $Lm_3$, Rmk(1.5 $Lm_3$), was 0.164 μm. FIG. 3C shows that Rmk along the calculation length in the range of 0.5 $Lm_3$ (μm) or more and 1.5 $Lm_3$ (μm) or less was 0.1 μm or more.

Exemplary Embodiments 18 and 19

Electrophotographic photosensitive members were produced and evaluated in the same manner as in Exemplary Embodiment 17 except that the intermediate layer had a thickness listed in Table 2. Tables 2 and 5 show the results.

Exemplary Embodiment 20

An electrophotographic photosensitive member was produced and evaluated in the same manner as in Exemplary Embodiment 17 except that 0.5 parts of the slurry containing silica particles dispersed in isopropanol mixed with the intermediate layer coating fluid was used. Tables 2 and 5 show the results.

Exemplary Embodiment 21

An electrophotographic photosensitive member was produced and evaluated in the same manner as in Exemplary Embodiment 17 except that 8.8 parts of the slurry containing silica particles dispersed in isopropanol mixed with the intermediate layer coating fluid was used. Tables 2 and 5 show the results.

Exemplary Embodiment 22

An electrophotographic photosensitive member was produced and evaluated in the same manner as in Exemplary Embodiment 17, except that, in the intermediate layer, the compound represented by the formula (A-1) was replaced with 5 parts of the compound represented by the formula (A-2), and 3 parts of the poly(vinyl acetal) resin was used. Tables 2 and 5 show the results.

Exemplary Embodiment 23

An electrophotographic photosensitive member was produced and evaluated in the same manner as in Exemplary Embodiment 17 except that the intermediate layer was formed as described below. Tables 2 and 5 show the results.

The intermediate layer was formed by the method described in Exemplary Embodiment 7.

Exemplary Embodiment 24

An electrophotographic photosensitive member was produced and evaluated in the same manner as in Exemplary Embodiment 17 except that the intermediate layer was formed as described below. Tables 2 and 5 show the results.

The slurry containing silica particles dispersed in isopropanol mixed with the intermediate layer coating fluid was replaced with 2 parts of the powder of alumina particles (trade name: LS-231). The powder of alumina particles was stirred with glass beads having a diameter of 0.8 mm in a paint shaker for 3 hours, and the glass beads were then removed. Except for these, the intermediate layer was formed in the same manner as in Exemplary Embodiment 17.

Exemplary Embodiment 25

The amount of silicone resin particles in the conductive layer was 5% by mass of the total mass of the metal oxide particles and the phenolic resin in the dispersion liquid after the glass beads were removed. Except for this, an electrophotographic photosensitive member was produced and evaluated in the same manner as in Exemplary Embodiment 17. Tables 2 and 5 show the results.

Exemplary Embodiment 26

An electrophotographic photosensitive member was produced and evaluated in the same manner as in Exemplary Embodiment 17, except that 0.33 parts of the slurry containing silica particles dispersed in isopropanol mixed with the intermediate layer coating fluid was used, and the intermediate layer had a thickness of 5.5 μm. Tables 2 and 5 show the results.

Exemplary Embodiments 27 to 29

Electrophotographic photosensitive members were produced and evaluated in the same manner as in Exemplary Embodiments 17 to 19 except that the intermediate layer was formed as described below. Tables 2 and 5 show the results. Exemplary Embodiment 27 corresponds to Exemplary Embodiment 17, Exemplary Embodiment 28 corresponds to Exemplary Embodiment 18, and Exemplary Embodiment 29 corresponds to Exemplary Embodiment 19.

The intermediate layer was formed in the same manner as in Exemplary Embodiment 17, except that the slurry containing silica particles dispersed in isopropanol (trade name: IPA-ST-UP) mixed with the intermediate layer coating fluid was replaced with 1.7 parts of another slurry containing silica particles dispersed in isopropanol (trade name: IPA-ST, silica ratio: 30% by mass), and the intermediate layer had a thickness listed in Table 2.

Exemplary Embodiment 30

An electrophotographic photosensitive member was produced and evaluated in the same manner as in Exemplary Embodiment 17 except that the slurry containing silica particles dispersed in isopropanol (trade name: IPA-ST-UP) mixed with the intermediate layer coating fluid was replaced with 0.2 parts of another slurry containing silica particles dispersed in isopropanol (trade name: IPA-ST). Tables 2 and 5 show the results.

Exemplary Embodiment 31

An electrophotographic photosensitive member was produced and evaluated in the same manner as in Exemplary Embodiment 17 except that the slurry containing silica particles dispersed in isopropanol (trade name: IPA-ST-UP) mixed with the intermediate layer coating fluid was replaced with 4.4 parts of another slurry containing silica particles dispersed in isopropanol (trade name: IPA-ST). Tables 2 and 5 show the results.

Exemplary Embodiment 32

An electrophotographic photosensitive member was produced and evaluated in the same manner as in Exemplary Embodiment 17 except that the slurry containing silica particles dispersed in isopropanol (trade name: IPA-ST-UP) mixed with the intermediate layer coating fluid was replaced with 1.7 parts of another slurry containing silica particles dispersed in isopropanol (trade name: IPA-ST-ZL). Tables 2 and 5 show the results.

Exemplary Embodiment 33

An electrophotographic photosensitive member was produced and evaluated in the same manner as in Exemplary Embodiment 17 except that the intermediate layer was formed as described below. Tables 2 and 5 show the results.

The slurry containing silica particles dispersed in isopropanol mixed with the intermediate layer coating fluid was replaced with 2.1 parts of the powder of titanium oxide particles (trade name: TTO-S-4). The powder of titanium oxide particles was stirred with glass beads having a diameter of 0.8 mm in a paint shaker for 3 hours, and the glass beads were then removed. Except for these, the intermediate layer was formed in the same manner as in Exemplary Embodiment 17.

Exemplary Embodiment 34

An electrophotographic photosensitive member was produced and evaluated in the same manner as in Exemplary Embodiment 17 except that the intermediate layer was formed as described below. Tables 2 and 5 show the results.

The compound represented by the formula (A-1) was not used in the intermediate layer coating fluid. The slurry containing silica particles dispersed in isopropanol was replaced with 7.1 parts of the powder of zinc oxide particles (trade name: ZnO-650). The powder of zinc oxide particles was stirred with glass beads having a diameter of 0.8 mm in a paint shaker for 3 hours, and the glass beads were then removed. Except for these, the intermediate layer was formed in the same manner as in Exemplary Embodiment 17.

Exemplary Embodiment 35

An electrophotographic photosensitive member was produced and evaluated in the same manner as in Exemplary Embodiment 17 except that the intermediate layer was formed as described below. Tables 2 and 5 show the results.

The slurry containing silica particles dispersed in isopropanol mixed with the intermediate layer coating fluid was replaced with 2.1 parts of a powder of titanium oxide particles (trade name: JR-403, manufactured by Tayca Corporation). The powder of titanium oxide particles was stirred with glass beads having a diameter of 0.8 mm in a paint shaker for 3 hours, and the glass beads were then removed. Thus, an intermediate layer coating fluid was prepared. The intermediate layer had a thickness of 5.5 μm. Except for these, the intermediate layer was formed in the same manner as in Exemplary Embodiment 17.

TABLE 2

| | Conductive layer | | | |
|---|---|---|---|---|
| | Rmk, max (μm) | $Lm_3$ (μm) | Rmk(0.5 $Lm_3$) (μm) | Rmk(1.5 $Lm_3$) (μm) |
| Exemplary embodiment 17 | 0.18 | 32.39 | 0.16 | 0.16 |
| Exemplary embodiment 18 | 0.18 | 32.39 | 0.16 | 0.16 |
| Exemplary embodiment 19 | 0.18 | 32.39 | 0.16 | 0.16 |
| Exemplary embodiment 20 | 0.18 | 32.39 | 0.16 | 0.16 |
| Exemplary embodiment 21 | 0.18 | 32.39 | 0.16 | 0.16 |
| Exemplary embodiment 22 | 0.18 | 32.39 | 0.16 | 0.16 |
| Exemplary embodiment 23 | 0.18 | 32.39 | 0.16 | 0.16 |
| Exemplary embodiment 24 | 0.18 | 32.39 | 0.16 | 0.16 |
| Exemplary embodiment 25 | 0.13 | 31.56 | 0.11 | 0.11 |
| Exemplary embodiment 26 | 0.18 | 32.39 | 0.16 | 0.16 |
| Exemplary embodiment 27 | 0.18 | 32.39 | 0.16 | 0.16 |
| Exemplary embodiment 28 | 0.18 | 32.39 | 0.16 | 0.16 |
| Exemplary embodiment 29 | 0.18 | 32.39 | 0.16 | 0.16 |
| Exemplary embodiment 30 | 0.18 | 32.39 | 0.16 | 0.16 |
| Exemplary embodiment 31 | 0.18 | 32.39 | 0.16 | 0.16 |
| Exemplary embodiment 32 | 0.18 | 32.39 | 0.16 | 0.16 |

TABLE 2-continued

| | | | | |
|---|---|---|---|---|
| Exemplary embodiment 33 | 0.18 | 32.39 | 0.16 | 0.16 |
| Exemplary embodiment 34 | 0.18 | 32.39 | 0.16 | 0.16 |
| Exemplary embodiment 35 | 0.18 | 32.39 | 0.16 | 0.16 |

| | Intermediate layer | | | | | | | | |
|---|---|---|---|---|---|---|---|---|---|
| | Rmk, max (μm) | $Lm_4$ (μm) | Rmk(0.5 $Lm_4$) (μm) | Rmk(1.5 $Lm_4$) (μm) | Thickness (μm) | Particles | Particle size (μm) | Particle content (vol %) | Solidity |
| Exemplary embodiment 17 | 0.15 | 40.14 | 0.13 | 0.14 | 1.0 | Silica | 0.06 | 5 | 0.54 |
| Exemplary embodiment 18 | 0.14 | 40.02 | 0.12 | 0.13 | 5.5 | Silica | 0.06 | 5 | 0.54 |
| Exemplary embodiment 19 | 0.17 | 39.99 | 0.14 | 0.15 | 0.5 | Silica | 0.06 | 5 | 0.54 |
| Exemplary embodiment 20 | 0.13 | 40.12 | 0.11 | 0.12 | 1.0 | Silica | 0.06 | 0.7 | 0.54 |
| Exemplary embodiment 21 | 0.16 | 40.06 | 0.14 | 0.14 | 1.0 | Silica | 0.06 | 13 | 0.54 |
| Exemplary embodiment 22 | 0.15 | 40.10 | 0.12 | 0.12 | 1.0 | Silica | 0.06 | 5 | 0.54 |
| Exemplary embodiment 23 | 0.11 | 41.55 | 0.10 | 0.09 | 5.5 | Titanium oxide | 0.18 | 5 | 0.77 |
| Exemplary embodiment 24 | 0.13 | 40.54 | 0.12 | 0.12 | 1.0 | Alumina | 0.10 | 5 | 0.88 |
| Exemplary embodiment 25 | 0.11 | 38.52 | 0.10 | 0.10 | 1.0 | Silica | 0.06 | 5 | 0.54 |
| Exemplary embodiment 26 | 0.13 | 40.03 | 0.11 | 0.11 | 5.5 | Silica | 0.06 | 0.5 | 0.54 |
| Exemplary embodiment 27 | 0.13 | 40.23 | 0.12 | 0.12 | 1.0 | Silica | 0.01 | 5 | 0.98 |
| Exemplary embodiment 28 | 0.13 | 38.22 | 0.11 | 0.12 | 5.5 | Silica | 0.01 | 5 | 0.98 |
| Exemplary embodiment 29 | 0.15 | 41.11 | 0.13 | 0.14 | 0.5 | Silica | 0.01 | 5 | 0.98 |
| Exemplary embodiment 30 | 0.13 | 40.01 | 0.12 | 0.12 | 1.0 | Silica | 0.01 | 0.7 | 0.98 |
| Exemplary embodiment 31 | 0.14 | 39.99 | 0.12 | 0.13 | 1.0 | Silica | 0.01 | 13 | 0.98 |
| Exemplary embodiment 32 | 0.13 | 40.62 | 0.12 | 0.12 | 1.0 | Silica | 0.09 | 5 | 0.98 |
| Exemplary embodiment 33 | 0.14 | 39.69 | 0.12 | 0.12 | 1.0 | Titanium oxide | 0.07 | 5 | 0.92 |
| Exemplary embodiment 34 | 0.14 | 40.32 | 0.13 | 0.13 | 1.0 | Zinc oxide | 0.03 | 19 | 0.95 |
| Exemplary embodiment 35 | 0.10 | 41.55 | 0.08 | 0.08 | 5.5 | Titanium oxide | 0.25 | 5 | 0.98 |

"Particles" in Table 2 refers to the type of particles dispersed in the intermediate layer. "Particle size" in Table 2 refers to the number-average particle size of particles measured by the Measurement of Number-Average Particle Size of Particles. "Particle content" in Table 2 refers to the particle content (% by volume) of the intermediate layer measured by the Measurement of Particle Content. "Solidity" in Table 2 refers to the solidity of particles measured by the Measurement of Solidity of Particles.

Comparative Example 1

Figure 3E:
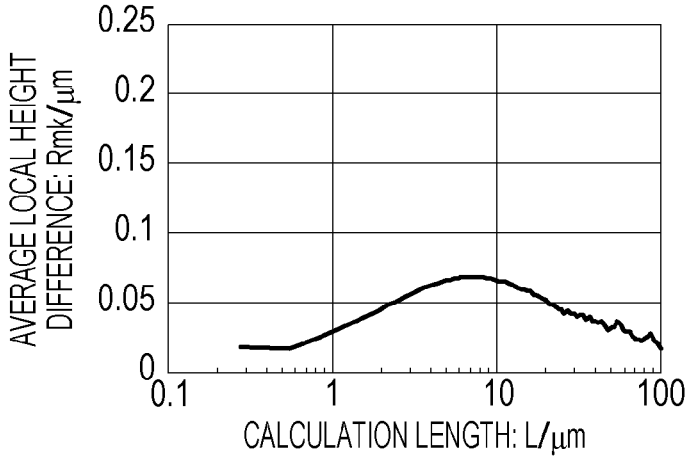
Figure 3F:
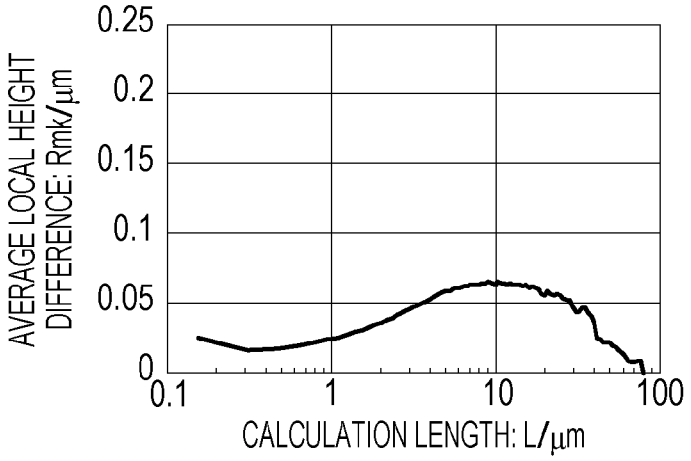

An electrophotographic photosensitive member was produced and evaluated in the same manner as in Exemplary Embodiment 1, except that an aluminum ED tube having a length of 260.5 mm and a diameter of 30 mm was used as the support, and the intermediate layer was formed as described below. Tables 3 and 5 show the results. FIG. 3E shows the Rmk(L) calculation results of the Measurement of Surface Profile of Support.

[Intermediate Layer]

Sixty parts of zinc oxide particles (manufactured by Tayca Corporation, average particle size: 50 nm) were mixed with 500 parts of toluene, and the mixture was mixed with 0.75 parts of a silane coupling agent (trade name: KBM603, manufactured by Shin-Etsu Chemical Co., Ltd.) for 2 hours. After that, toluene was removed by vacuum distillation, and the mixture was dried at 140° C. for 6 hours, thus producing zinc oxide particles surface-treated with the silane coupling agent.

9.2 parts of the zinc oxide particles surface-treated with the silane coupling agent, 1 part of alizarin, 22.5 parts of a blocked isocyanate compound (trade name: Sumidur BL-3175, manufactured by Sumika Bayer Urethane Co., Ltd.), and 25 parts of a butyral resin (trade name: BM-1, manufactured by Sekisui Chemical Co., Ltd.)

were mixed with 150 parts of methyl ethyl ketone to prepare a dispersion liquid. Then, 40 parts of the dispersion liquid was mixed with 50 parts of methyl ethyl ketone and was dispersed with glass beads having a diameter of 0.8 mm in a sand mill for 5 hours. After the glass beads were removed, a dispersion liquid was obtained.

The dispersion liquid was mixed with 0.008 parts of a catalyst dioctyltin dilaurate. Thus, an intermediate layer coating fluid was prepared. The intermediate layer coating fluid was applied to the support by dip coating to form a coating film, and the coating film was dried and cured at 150° C. for 30 minutes to form an intermediate layer having a thickness of 5 μm.

Comparative Example 2

An electrophotographic photosensitive member was produced and evaluated in the same manner as in Comparative Example 1 except that the intermediate layer was formed as described below. Tables 3 and 5 show the results.

The intermediate layer was formed by the method described in Exemplary Embodiment 6.

Comparative Example 3

An electrophotographic photosensitive member was produced and evaluated in the same manner as in Exemplary Embodiment 9 except that the intermediate layer was formed as described below. Tables 3 and 5 show the results.

The slurry containing silica particles dispersed in isopropanol was not used in the intermediate layer coating fluid. The compound represented by the formula (A-1) was replaced with 5 parts of the compound represented by the formula (A-2), and 3 parts of the poly(vinyl acetal) resin was used. The intermediate layer had a thickness of 5 μm. Except for these, the intermediate layer was formed in the same manner as in Exemplary Embodiment 9.

Comparative Example 4

An electrophotographic photosensitive member was produced and evaluated in the same manner as in Exemplary Embodiment 9 except that the intermediate layer was formed as described below. Tables 3 and 5 show the results.

[Intermediate Layer]

Five parts of the compound represented by the formula (A-2), 1.4 parts of silica particles (trade name: Sciqas 0.4 μm, manufactured by Sakai Chemical Industry Co., Ltd.), 15 parts of an alkyd resin (trade name: Beckolite M6401-50-S, manufactured by DIC Corporation), 10 parts of a melamine resin (trade name: Super Beckamine L-121-60, manufactured by DIC Corporation), and 90 parts of methyl ethyl ketone were mixed in a ball mill for 72 hours to prepare an intermediate layer coating fluid. The intermediate layer coating fluid was applied to the support by dip coating to form a coating film, and the coating film was dried and cured at 120° C. for 30 minutes to form an intermediate layer having a thickness of 5 μm.

TABLE 3

| | Support | | | |
|---|---|---|---|---|
| | Rmk, max (μm) | $Lm_1$ (μm) | Rmk(0.5 $Lm_1$) (μm) | Rmk(1.5 $Lm_1$) (μm) |
| Comparative example 1 | 0.07 | 7.20 | 0.06 | 0.07 |
| Comparative example 2 | 0.07 | 7.20 | 0.06 | 0.07 |
| Comparative example 3 | 0.12 | 6.09 | 0.10 | 0.11 |
| Comparative example 4 | 0.12 | 6.09 | 0.10 | 0.11 |

TABLE 3-continued

| | Intermediate layer | | | | | | | | |
|---|---|---|---|---|---|---|---|---|---|
| | Rmk, max (μm) | Lm (μm) | Rmk(0.5 $Lm_2$) (μm) | Rmk(1.5 $Lm_2$) (μm) | Thickness (μm) | Particles | Particle size (μm) | Particle content (vol %) | Solidity |
| Comparative example 1 | 0.06 | 7.04 | 0.04 | 0.05 | 5.0 | Zinc oxide | 0.05 | 19 | 0.95 |
| Comparative example 2 | 0.06 | 7.73 | 0.05 | 0.05 | 1.0 | Silica | 0.06 | 5 | 0.54 |
| Comparative example 3 | 0.07 | 5.82 | 0.06 | 0.05 | 5.0 | — | — | — | — |
| Comparative example 4 | 0.08 | 5.55 | 0.07 | 0.07 | 5.0 | Silica | 0.40 | 5 | 0.99 |

"Particles" in Table 3 refers to the type of particles dispersed in the intermediate layer. "Particle size" in Table 3 refers to the number-average particle size of particles measured by the Measurement of Number-Average Particle Size of Particles. "Particle content" in Table 3 refers to the particle content (% by volume) of the intermediate layer measured by the Measurement of Particle Content. "Solidity" in Table 3 refers to the solidity of particles measured by the Measurement of Solidity of Particles.

Comparative Example 5

An electrophotographic photosensitive member was produced and evaluated in the same manner as in Exemplary Embodiment 22 except that the conductive layer was formed as described below. Tables 4 and 5 show the results.

[Conductive Layer]

Sixty parts of zinc oxide particles (manufactured by Tayca Corporation, average particle size: 50 nm) were mixed with 500 parts of toluene, and the mixture was mixed with 0.75 parts of a silane coupling agent (trade name: KBM603) for 2 hours. After that, toluene was removed by vacuum distillation, and the mixture was dried at 140° C. for hours, thus producing zinc oxide particles surface-treated with the silane coupling agent.

A hundred parts of the zinc oxide particles surface-treated with the silane coupling agent,
1 part of alizarin,
22.5 parts of a blocked isocyanate compound (trade name: Sumidur BL-3175, manufactured by Sumika Bayer Urethane Co., Ltd.), and
25 parts of a butyral resin (trade name: BM-1, manufactured by Sekisui Chemical Co., Ltd.)

were mixed with 150 parts of methyl ethyl ketone to prepare a dispersion liquid. Then, 40 parts of the dispersion liquid was mixed with 25 parts of methyl ethyl ketone and was dispersed with glass beads having a diameter of 0.8 mm in a sand mill for 5 hours. After the glass beads were removed, a dispersion liquid was obtained.

The dispersion liquid was mixed with 0.008 parts of a catalyst dioctyltin dilaurate and 6 parts of silicone resin particles (Tospearl 120, average particle size: 2 μm). Thus, a conductive layer coating fluid was prepared. The conductive layer coating fluid was applied to the support by dip coating to form a coating film, and the coating film was dried and cured at 150° C. for 30 minutes to form a conductive layer having a thickness of 15 μm.

Comparative Example 6

An electrophotographic photosensitive member was produced and evaluated in the same manner as in Exemplary Embodiment 25 except that the intermediate layer was formed as described below. Tables 4 and 5 show the results.

The intermediate layer was formed by the method described in Comparative Example 3.

Comparative Example 7

An electrophotographic photosensitive member was produced and evaluated in the same manner as in Exemplary Embodiment 25 except that the intermediate layer was formed as described below. Tables 4 and 5 show the results.

The intermediate layer was formed by the method described in Comparative Example 4.

TABLE 4

| | Conductive layer | | | |
|---|---|---|---|---|
| | Rmk, max (μm) | $Lm_3$ (μm) | Rmk(0.5 $Lm_3$) (μm) | Rmk(1.5 $Lm_3$) (μm) |
| Comparative example 5 | 0.07 | 10.31 | 0.06 | 0.06 |
| Comparative example 6 | 0.13 | 31.56 | 0.11 | 0.11 |
| Comparative example 7 | 0.13 | 31.56 | 0.11 | 0.11 |

TABLE 4-continued

| | Intermediate layer | | | | | | | | |
|---|---|---|---|---|---|---|---|---|---|
| | Rmk, max (μm) | Lm (μm) | Rmk(0.5 $Lm_4$) (μm) | Rmk(1.5 $Lm_4$) (μm) | Thickness (μm) | Particles | Particle size (μm) | Particle content (vol %) | Solidity |
| Comparative example 5 | 0.06 | 13.58 | 0.04 | 0.05 | 1.0 | Silica | 0.06 | 5 | 0.54 |
| Comparative example 6 | 0.06 | 38.14 | 0.05 | 0.05 | 5.0 | — | — | — | — |
| Comparative example 7 | 0.08 | 35.11 | 0.07 | 0.07 | 5.0 | Silica | 0.40 | 5 | 0.99 |

"Particles" in Table 4 refers to the type of particles dispersed in the intermediate layer. "Particle size" in Table 4 refers to the number-average particle size of particles measured by the Measurement of Number-Average Particle Size of Particles. "Particle content" in Table 4 refers to the particle content (% by volume) of the intermediate layer measured by the Measurement of Particle Content. "Solidity" in Table 4 refers to the solidity of particles measured by the Measurement of Solidity of Particles.

TABLE 5

| | Interference fringe rating | |
|---|---|---|
| | Method A for forming charge-transport layer | Method B for forming charge-transport layer |
| Exemplary embodiment 1 | a | a |
| Exemplary embodiment 2 | a | a |
| Exemplary embodiment 3 | a | a |
| Exemplary embodiment 4 | a | a |
| Exemplary embodiment 5 | a | a |
| Exemplary embodiment 6 | a | a |
| Exemplary embodiment 7 | b | a |
| Exemplary embodiment 8 | a | a |
| Exemplary embodiment 9 | b | a |
| Exemplary embodiment 10 | a | a |
| Exemplary embodiment 11 | a | a |
| Exemplary embodiment 12 | a | a |
| Exemplary embodiment 13 | a | a |
| Exemplary embodiment 14 | a | a |
| Exemplary embodiment 15 | a | a |
| Exemplary embodiment 16 | a | a |
| Exemplary embodiment 17 | a | a |
| Exemplary embodiment 18 | a | a |
| Exemplary embodiment 19 | a | a |
| Exemplary embodiment 20 | a | a |
| Exemplary embodiment 21 | a | a |

TABLE 5-continued

| | Interference fringe rating | |
|---|---|---|
| | Method A for forming charge-transport layer | Method B for forming charge-transport layer |
| Exemplary embodiment 22 | a | a |
| Exemplary embodiment 23 | b | a |
| Exemplary embodiment 24 | a | a |
| Exemplary embodiment 25 | b | a |
| Exemplary embodiment 26 | a | a |
| Exemplary embodiment 27 | a | a |
| Exemplary embodiment 28 | a | a |
| Exemplary embodiment 29 | a | a |
| Exemplary embodiment 30 | a | a |
| Exemplary embodiment 31 | a | a |
| Exemplary embodiment 32 | a | a |
| Exemplary embodiment 33 | a | a |
| Exemplary embodiment 34 | a | a |
| Exemplary embodiment 35 | b | b |
| Comparative example 1 | d | d |
| Comparative example 2 | d | d |
| Comparative example 3 | d | c |
| Comparative example 4 | c | b |
| Comparative example 5 | d | c |
| Comparative example 6 | c | c |
| Comparative example 7 | c | b |

Exemplary Embodiments 36 and 37

Electrophotographic photosensitive members were produced and evaluated in the same manner as in Exemplary Embodiments 17 and 27 except that the support was an aluminum ED tube having a length of 260.5 mm and a diameter of 30 mm. Tables 6 and 7 show the results.

TABLE 6

| | Conductive layer | | | |
|---|---|---|---|---|
| | Rmk, max (μm) | $Lm_3$ (μm) | Rmk(0.5 $Lm_3$) (μm) | Rmk(1.5 $Lm_3$) (μm) |
| Exemplary embodiment 36 | 0.18 | 32.40 | 0.16 | 0.17 |
| Exemplary embodiment 37 | 0.18 | 32.40 | 0.16 | 0.17 |

| | Intermediate layer | | | | | | | | |
|---|---|---|---|---|---|---|---|---|---|
| | Rmk, max (μm) | Lm (μm) | Rmk(0.5 $Lm_4$) (μm) | Rmk(1.5 $Lm_4$) (μm) | Thickness (μm) | Particles | Particle size (μm) | Particle content (vol %) | Solidity |
| Exemplary embodiment 36 | 0.15 | 40.14 | 0.14 | 0.14 | 1.0 | Silica | 0.06 | 5 | 0.54 |
| Exemplary embodiment 37 | 0.13 | 40.24 | 0.12 | 0.12 | 1.0 | Silica | 0.01 | 5 | 0.98 |

"Particles" in Table 6 refers to the type of particles dispersed in the intermediate layer. "Particle size" in Table 6 refers to the number-average particle size of particles measured by the Measurement of Number-Average Particle Size of Particles. "Particle content" in Table 6 refers to the particle content (% by volume) of the intermediate layer measured by the Measurement of Particle Content. "Solidity" in Table 6 refers to the solidity of particles measured by the Measurement of Solidity of Particles.

TABLE 7

| | Interference fringe rating | |
|---|---|---|
| | Method A for forming charge-transport layer | Method B for forming charge-transport layer |
| Exemplary embodiment 36 | a | a |
| Exemplary embodiment 37 | a | a |

"Interference fringe rating Method A for forming charge-transport layer" in Tables 5 and 7 refers to ratings with respect to interference fringes for the electrophotographic photosensitive member produced by the method A for forming a charge-transport layer. "Interference fringe rating Method B for forming charge-transport layer" in Tables 5 and 7 refers to ratings with respect to interference fringes for the electrophotographic photosensitive member produced by the method B for forming a charge-transport layer.

Comparisons of the exemplary embodiments and the comparative examples show that interference fringes were insufficiently reduced in the comparative examples.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-012707 filed Jan. 26, 2015 and No. 2015-118571 filed Jun. 11, 2015, which are hereby incorporated by reference herein in their entirety.

What is claimed is:

1. An electrophotographic photosensitive member, comprising: an electrically conductive support; an intermediate layer adjacent to the electrically conductive support; a charge-generating layer; and a charge-transport layer in this order, wherein:

the intermediate layer has a thickness of 6.0 μm or less, the intermediate layer is a cured film containing:

dispersed inorganic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of the electrically conductive support has an average local height difference (Rmk) of 0.1 μm or more along a calculation length in the range of 0.5 $Lm_1$ (μm) or more and 1.5 $Lm_1$ (μm) or less, and a surface of the intermediate layer has an average local height difference (Rmk) of 0.08 μm or more along a calculation length in the range of 0.5 $Lm_2$ (μm) or more and 1.5 $Lm_2$ (μm) or less, wherein $Lm_1$ denotes a calculation length in the range of 0.1 μm or more and 100 μm or less along which the surface of the support has a maximum average local height difference (Rmk,max), and $Lm_2$ denotes a calculation length in the range of 0.1 μm or more and 100 μm or less along which the surface of the intermediate layer has a maximum average local height difference (Rmk,max).

2. The electrophotographic photosensitive member according to claim 1, wherein the inorganic particles contain at least one selected from the group consisting of silica, titanium oxide, zinc oxide, and alumina.

3. The electrophotographic photosensitive member according to claim 1, wherein the cured film contains a polymer of a composition containing an organic compound having a polymerizable functional group.

4. An electrophotographic photosensitive member, comprising: an electrically conductive support; a conductive layer; an intermediate layer adjacent to the conductive layer; a charge-generating layer; and a charge-transport layer in this order, wherein:

the intermediate layer has a thickness of 6.0 μm or less, the intermediate layer is a cured film containing:

dispersed inorganic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of the conductive layer has an average local height difference (Rmk) of 0.1 μm or more along a calculation length in the range of 0.5 $Lm_3$ (μm) or more and 1.5 $Lm_3$ (μm) or less, and a surface of the intermediate layer has an average local height difference (Rmk) of 0.08 μm or more along a calculation length in the range of 0.5 $Lm_4$ (μm) or more and 1.5 $Lm_4$ (μm) or less, wherein $Lm_3$ denotes a calculation length in the range of 0.1 μm or more and 100 μm or less along which the surface of the conductive layer has a maximum average local height difference (Rmk,max), and $Lm_4$ denotes a calculation length in the range of 0.1 μm or more and 100 μm or less along which the surface of the intermediate layer has a maximum average local height difference (Rmk,max).

5. The electrophotographic photosensitive member according to claim 4, wherein the conductive layer contains resin particles and a binder resin.

6. A process cartridge detachably attachable to a main body of an electrophotographic apparatus, wherein the process cartridge integrally supports an electrophotographic photosensitive member and at least one device selected from the group consisting of a charging device, a developing device, a transfer device, and a cleaning device, the electrophotographic photosensitive member includes an electrically conductive support, an intermediate layer adjacent to electrically conductive support, a charge-generating layer, and a charge-transport layer in this order, wherein:

the intermediate layer has a thickness of 6.0 μm or less, the intermediate layer is a cured film containing:

dispersed organic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of electrically conductive support has an average local height difference (Rmk) of 0.1 μm or more along a calculation length in the range of 0.5 $Lm_1$ (μm) or more and 1.5 $Lm_1$ (μm) or less, and a surface of the intermediate layer has an average local height difference (Rmk) of 0.08 μm or more along a calculation length in the range of 0.5 $Lm_2$ (μm) or more and 1.5 $Lm_2$ (μm) or less, wherein $Lm_1$ denotes a calculation length in the range of 0.1 μm or more and 100 μm or less along which the surface of the support has a maximum average local height difference (Rmk,max), and $Lm_2$ denotes a calculation length in the range of 0.1 μm or more and 100 μm or less along which the surface of the intermediate layer has a maximum average local height difference (Rmk,max).

7. A process cartridge detachably attachable to a main body of an electrophotographic apparatus, wherein the process cartridge integrally supports an electrophotographic photosensitive member and at least one device selected from the group consisting of a charging device, a developing device, a transfer device, and a cleaning device, the electrophotographic photosensitive member includes an electrically conductive support, a conductive layer, an intermediate layer adjacent to the conductive layer, a charge-generating layer, and a charge-transport layer in this order, wherein:

the intermediate layer has a thickness of 6.0 μm or less, the intermediate layer is a cured film containing:

dispersed organic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of the conductive layer has an average local height difference (Rmk) of 0.1 μm or more along a calculation length in the range of 0.5 $Lm_3$ (μm) or more and 1.5 $Lm_3$ (μm) or less, and a surface of the intermediate layer has an average local height difference (Rmk) of 0.08 μm or more along a calculation length in the range of 0.5 $Lm_4$ (μm) or more and 1.5 $Lm_4$ (μm) or less, wherein $Lm_3$ denotes a calculation length in the range of 0.1 μm or more and 100 μm or less along which the surface of the conductive layer has a maximum average local height difference (Rmk,max), and $Lm_4$ denotes a calculation length in the range of 0.1 μm or more and 100 μm or less along which the surface of the intermediate layer has a maximum average local height difference (Rmk,max).

8. An electrophotographic apparatus, comprising: an electrophotographic photosensitive member; a charging device; an exposure device; a developing device; and a transfer device, wherein the electrophotographic photosensitive member includes an electrically conductive support, an intermediate layer adjacent to electrically conductive support, a charge-generating layer, and a charge-transport layer in this order, wherein:

the intermediate layer has a thickness of 6.0 μm or less, the intermediate layer is a cured film containing:

dispersed organic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of electrically conductive support has an average local height difference (Rmk) of 0.1 μm or more along a calculation length in the range of 0.5 $Lm_1$ (μm) or more and 1.5 $Lm_1$ (μm) or less, and a surface of the intermediate layer has an average local height difference (Rmk) of 0.08 μm or more along a calculation length in the range of 0.5 $Lm_2$ (μm) or more and 1.5 $Lm_2$ (μm) or less, wherein $Lm_1$ denotes a calculation length in the range of 0.1 μm or more and 100 μm or less along which the surface of electrically conductive support has a maximum average local height difference (Rmk,max), and $Lm_2$ denotes a calculation length in the range of 0.1 μm or more and 100 μm or less along which the surface of the intermediate layer has a maximum average local height difference (Rmk,max).

9. An electrophotographic apparatus, comprising: an electrophotographic photosensitive member; a charging device; an exposure device; a developing device; and a transfer device, the electrophotographic photosensitive member includes an electrically conductive support, a conductive layer, an intermediate layer adjacent to the conductive layer, a charge-generating layer, and a charge-transport layer in this order, wherein:

the intermediate layer has a thickness of 6.0 μm or less, the intermediate layer is a cured film containing:

dispersed organic particles having a number-average particle size of 0.3 μm or less having a solidity of 0.90 or less, and a polymerized product of a composition containing an electron-transport substance having a polymerizable functional group and a crosslinking agent, a content of the dispersed inorganic particles is 0.7% or more by volume and 13% or less by volume of the total volume of the intermediate layer, a surface of the conductive layer has an average local height difference (Rmk) of 0.1 μm or more along a calculation length in the range of 0.5 $Lm_3$ (μm) or more and 1.5 $Lm_3$ (μm) or less, and a surface of the intermediate layer has an average local height difference (Rmk) of 0.08 μm or more along a calculation length in the range of 0.5 $Lm_4$ (μm) or more and 1.5 $Lm_4$ (μm) or less, wherein $Lm_3$ denotes a calculation length in the range of 0.1 μm or more and 100 μm or less along which the surface of the conductive layer has a maximum average local height difference (Rmk,max), and $Lm_4$ denotes a calculation length in the range of 0.1 μm or more and 100 μm or less along which the surface of the intermediate layer has a maximum average local height difference (Rmk,max).

* * * * *